US007462080B2

(12) United States Patent
Shiraishi et al.

(10) Patent No.: US 7,462,080 B2
(45) Date of Patent: Dec. 9, 2008

(54) PERPENDICULAR FITTING FEMALE TERMINAL AND HOUSING TO MOUNT IT THEREIN

(75) Inventors: Makoto Shiraishi, Aichi (JP); Makoto Amagasaki, Aichi (JP); Yoshihide Uchida, Okayama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/580,055

(22) Filed: Oct. 13, 2006

(65) Prior Publication Data

US 2007/0093130 A1 Apr. 26, 2007

(30) Foreign Application Priority Data

Oct. 13, 2005 (JP) ..... 2005-299461
Jan. 5, 2006 (JP) ..... 2006-000970

(51) Int. Cl.
*H01R 11/22* (2006.01)
*H01R 13/11* (2006.01)

(52) U.S. Cl. ..... 439/852; 439/854

(58) Field of Classification Search ..... 439/852, 439/854, 855, 881, 845
See application file for complete search history.

(56) References Cited

U.S. PATENT DOCUMENTS 3,312,931 A 4/1967 Keller
3,456,235 A * 7/1969 Kennedy ..... 439/855
4,082,412 A * 4/1978 Lennon ..... 439/854
5,344,348 A * 9/1994 Willis et al. ..... 439/849
6,042,433 A * 3/2000 Chen ..... 439/852
6,206,738 B1 * 3/2001 Sugie ..... 439/852
6,506,084 B2 * 1/2003 Saitoh ..... 439/852
6,547,608 B2 * 4/2003 Sato et al. ..... 439/852
7,241,189 B2 * 7/2007 Mohs et al. ..... 439/845

(Continued)

FOREIGN PATENT DOCUMENTS

DE 1 465 124 A1 1/1969

(Continued)

OTHER PUBLICATIONS

European Search Report, Ref. P027215EP, App. No. 06255245.0, Mar. 9, 2007 (4 pages).

(Continued)

*Primary Examiner*—Hae Moon Hyeon
(74) *Attorney, Agent, or Firm*—Rader, Fishman & Grauer, PLLC

(57) ABSTRACT

The perpendicular fitting female terminal according to the present invention comprises a tubular body having two first walls facing in a height direction and opposing to each other and two second walls facing in a width direction and opposing to each other, and extending in a depth direction, and a connecting part being aligned with the body in the depth direction and being integrally provided with the body, and being able to be connected to a conductor including electric wire. The two second walls of this perpendicular fitting female terminal are provided respectively with receiving holes penetrating, and inside the body is provided a leaf spring that undergoes elastic deformation in the height direction, and when a plug is accepted through any receiving hole, the leaf spring is pressed by the plug to undergo elastic deformation in the height direction.

13 Claims, 15 Drawing Sheets

U.S. PATENT DOCUMENTS

| | | | | |
|---|---|---|---|---|
| 2003/0060090 | A1 * | 3/2003 | Allgood et al. | 439/845 |
| 2004/0127108 | A1 | 7/2004 | Giro et al. | |

FOREIGN PATENT DOCUMENTS

| | | | |
|---|---|---|---|
| EP | 0 716 478 | A2 | 12/1995 |
| FR | 2 849 295 | A1 | 12/2002 |
| JP | 58-179767 | U | 12/1983 |
| JP | 06-0054252 | U | 7/1994 |
| JP | 06-208862 | A | 7/1994 |
| JP | 06-084682 | U | 12/1994 |
| JP | 2537455 | B1 | 7/1996 |
| JP | 09-199244 | A | 7/1997 |
| JP | 10-125380 | A | 5/1998 |

OTHER PUBLICATIONS

European Search Report, Ref. P027215EP, Application No. 06255245.0-2214, Dated Jun. 11, 2007 (8 pages).

* cited by examiner

PERPENDICULAR FITTING FEMALE TERMINAL AND HOUSING TO MOUNT IT THEREIN

BACKGROUND OF THE INVENTION

1. Field of the Invention

The perpendicular fitting female terminal according to the present invention belongs to a technical field of female terminals that extend in a direction substantially perpendicular to a direction a counterpart plug extends at the time of fitting-up.

2. Description of Related Art

Japanese Utility Model Publication (Unexamined) No. Showa 58-179767 and Japanese Utility Model Publication (Unexamined) No. Heisei 6-84682 disclose female terminals of this kind. The terminal disclosed by Japanese Utility Model Publication (Unexamined) No. Showa 58-179767 is a plug-in terminal comprising: an approximately-U-letter-shaped plug-in terminal being provided at one end thereof with rising parts opposing to each other; a central bottom of the rising parts being provided with a hole; the rising parts being provided at some parts thereof with contacting parts for contacting a counterpart input terminal; each of the rising parts being provided with a tongue having a top end being on the central bottom hole side; and the top end of the tongue being tilted towards the input terminal side. The terminal disclosed by Japanese Utility Model Publication (Unexamined) No. Heisei 6-84682 is used in a connector for electric wire, comprising: a box-shaped socket housing having insertion holes for plug pin at predetermined positions; a terminal to be mounted in the socket housing; said insertion holes for plug pin being provided in a direction perpendicular to the terminal to be mounted; and said terminal being provided on one end side with a connecting part for crimp-holding a wire and on the other end side and in positions corresponding to said insertion holes with pin terminal contacts for contacting a plug pin with pressure.

SUMMARY OF THE INVENTION

Such female contacts can realize downsizing by restraining the overall length of the female contact and the plug at the time of fitting-up in comparison with female terminals that are structured to extend in the same direction with the extending direction of a counterpart plug at the time of fitting-up and receive the plug through the top end thereof.

When such a female terminal and a plug are to be fitted together, it might be difficult to fit them due to some restraints relating to the surrounding space. Furthermore, when a plurality of female terminals are mounted on a housing to obtain an electric connector, there are requests for cost reduction through the use of a common female terminal.

When such a female terminal and a plug are to be fitted together or to be separated from each other, the female terminal tends to receive prying forces from the plug in many cases. When a female terminal and a plug are to be fitted together, the plug will make the spring of the female terminal undergo elastic deformation, and a contact force will be generated between the spring and the plug. To overcome this contact force and fit the female terminal and the plug together, it is a practice to also apply a force in a direction crossing the fitting-up direction so as to sway the female terminal or the plug and fit them together. The forces that are received by the female terminal at that time are prying forces. Moreover, when a female terminal and a plug are to be separated from each other, to separate the female terminal and the plug by overcoming the contact force between the spring and the plug, similar actions will be given, and in turn, the female terminal will be subjected to prying forces. In this case, it is desired to downsize the female terminal, enhance its strength against prying forces as high as possible and effectively prevent deformation of the female terminal so as to ensure stable fitting-up of the female terminal and the plug over a long period.

The present invention was made in view of such points, and its object is to provide a perpendicular fitting female terminal wherein a plug can be fitted into a tubular body in either of two opposing directions and in turn, the probability of fitting the plug can be raised in spite of spatial restraints, the perpendicular fitting female terminal can be used commonly in assembling an electric connector, the strength against prying force is high irrespective of fitting-up direction, deformation is effectively prevented to secure stable fitting with the plug over a long period, and the overall length including that of the plug at the time of fitting-up can be shortened.

The present invention is a perpendicular fitting female terminal for fitting with a plug, comprising: a tubular body having two first walls facing in a height direction and opposing to each other and two second walls facing in a width direction perpendicular to the height direction and opposing to each other, and extending in a depth direction perpendicular to both the height direction and the width direction; and a connecting part being aligned with the body in the depth direction and being integrally provided with the body, and being able to be connected to a conductor including electric wire; and the two second walls being provided respectively with receiving holes penetrating; inside the body a leaf spring being provided to undergo elastic deformation in the height direction; and subject to a plug being accepted through any receiving hole, the leaf spring to be pressed by the plug to undergo elastic deformation in the height direction.

When a conductor such as electric wire is connected to the connecting part and a plug is accepted in any receiving hole of the body, the leaf spring will be pressed by the plug to undergo elastic deformation in the height direction, and in turn, the perpendicular fitting female terminal and the plug will be fitted together with a contact force, and the perpendicular fitting female terminal and the plug will be connected together mechanically and electrically. When the receiving hole of the body and the plug are separated, the perpendicular fitting female terminal and the plug will be disconnected from each other. In this case, in comparison with a female terminal that is structured to extend in the same direction with the extending direction of a plug at the time of fitting-up and accept the plug through the top end thereof, the overall length of the perpendicular fitting female terminal and the plug at the time of fitting-up can be restrained and shortened.

When one attempts to receive a plug through one receiving hole to fit up the perpendicular fitting female terminal and the plug, if they can not be fitted together because of the restraints given by the surrounding space, it might be possible, sometimes, to receive the plug through the other receiving hole to fit up the perpendicular fitting female terminal and the plug. As a result of this, the probability of fitting up the perpendicular fitting female terminal and the plug improves. Moreover, when a plurality of female terminals are assembled in a housing to make an electric connector, this perpendicular fitting female terminal can be assembled into the housing in two modes, namely, one for accepting the plug through one receiving hole and the other one for accepting the plug through the other receiving hole by reversing the perpendicular fitting female terminal. Hence female terminals to be arranged in a plurality of locations can be provided by this perpendicular fitting female terminal, and this in turn advances common use of this same female terminal for female terminals to be arranged in a plurality of locations, lowering the costs.

When the perpendicular fitting female terminal is to be fitted with the plug or to be separated from the plug, even if the perpendicular fitting female terminal is subjected to a prying force by the plug, the perpendicular fitting female terminal exhibits high strength against prying forces because the body is structured to have a tubular form having two first walls opposing to each other in the height direction and two second walls opposing to each other in the width direction, and the body has high strengths including bending strength and twisting strength. Thus the perpendicular fitting female terminal is effectively prevented from deformation to ensure stable fitting-up of the perpendicular fitting female terminal and the plug over a long period.

Accordingly, the perpendicular fitting female terminal according to the present invention has succeeded in providing a perpendicular fitting female terminal wherein a plug can be fitted in the tubular body in either two directions opposing to each other, hence the probability of fitting the plug in spite of spatial restraints can be raised, the perpendicular fitting terminal can be used commonly in assembling it in an electric connector, the terminal has high strength against prying forces with the plug inserted in either direction to effectively prevent deformation and ensure stable fitting-up with the plug over a long period, and the overall length including the plug at the time of fitting-up can be shortened.

Said perpendicular fitting female terminal may be so formed that the first wall is integrally provided on both ends in the width direction with the second walls, the second walls are integrally provided with end walls facing in the height direction and opposing to said first wall, and the end walls are overlapped with each other to form the first wall opposing to said first wall.

With this arrangement, as the end walls are overlapped with each other, the bending strength, twisting strength and other strengths of the body are enhanced more, the strength against prying forces is enhanced more, and the perpendicular fitting female terminal is effectively prevented from deformation to ensure stable fitting-up of the perpendicular fitting female terminal and the plug over a long period.

Said perpendicular fitting female terminal may be so formed that the connecting part comprises a base extending from the first wall or the second wall in the depth direction, and an insulation barrel and a wire barrel both rising from the base in the height direction or the width direction on a side opposite to the body side.

The perpendicular fitting female terminal wherein the insulation barrel and the wire barrel are provided on the side opposite to the body as described above has, in comparison with the perpendicular fitting female terminal wherein the insulation barrel and the wire barrel are provided on the same side with the body, a greater configuration change in the height direction or in the width direction in a neighborhood of the boundary between the body and the connecting part, and as a whole exhibits a stepped configuration. Hence it is suitable when a space in which the perpendicular fitting female terminal is for example a curved space.

Said perpendicular fitting female terminal may be so formed that inside the body the leaf spring is provided by a plate piece reversing from one end in the width direction of the first wall, extending to the other end in the width direction of said first wall, and having a top end reversed towards said first wall.

With this arrangement, as the top end of the plug is smoothly guided by the reversed part to the face on the contact side of the leaf spring, the resistance at the time of fitting-up is reduced and the fitting force is reduced. Moreover, inside the body, it is easier to work on the reversed part in comparison with a case wherein a leaf spring extending in the depth direction is provided and an edge in the width direction thereof is reversed. Furthermore, as the leaf spring is constituted by reversing it from one end of the first wall, the dimension in the height direction of the body is smaller in comparison with a case wherein, for example, a separate spring is assembled.

Said perpendicular fitting female terminal may be so formed that the first wall is comprised of end walls overlapping with each other in the height direction, the leaf spring is provided by a plate piece reversing from one end in the width direction of the inner end wall, extending towards the other end in the width direction of said inner end wall, and having a top end thereof reversed towards said inner end wall, and said inner end wall is partly removed to provide a storing part for storing the top end of the leaf spring when the leaf spring undergoes elastic deformation.

With this arrangement, as the top end of the plug is smoothly guided by the reversed part onto the face on the contact side of the leaf spring, the resistance at the time of fitting-up is reduced, and the fitting force is reduced. Moreover, it is easier to work on the reversed part in comparison with a case wherein inside the body, a leaf spring extending in the depth direction is provided and an edge in the width direction thereof is reversed. And as the leaf spring is constituted by reversing it from one end of the end wall comprising the first wall, the dimension in the height direction of the body is smaller in comparison with a case wherein, for example, a separate spring is assembled. Furthermore, as the thickness of the storing part can be used for a part or the entirety of the displacement of the leaf spring, the dimension in the height direction of the body is reduced.

Said perpendicular fitting female terminal may be so formed that the leaf spring is provided with curved or tilted guiding parts extending from a neighborhood of a center in the width direction towards both the ends in the width direction while backing away in the height direction from the receiving holes.

With this arrangement, as the top end of the plug is smoothly guided onto the contact side of the leaf spring, the resistance at the time of fitting-up is reduced, and the fitting force is reduced.

Said perpendicular fitting female terminal may be so formed that the first wall is provided with the leaf spring, and the first wall opposing to said first wall is provided in a neighborhood of a center in the width direction of the first wall with a depressed part depressed towards the leaf spring and continuously provided from an end of the body on the side opposite to the connecting part side.

With this arrangement, for example, the perpendicular fitting female terminal is to be inserted into a hole, etc. of a housing, if a convex part corresponding to said depressed part is provided in the housing to face the hole, etc., a reverse insertion prevention function is exhibited. The reason is that even if the perpendicular fitting female terminal is reversed in the height direction and an attempt is made to insert it into the hole, etc. of the housing, the convex part will hit on the body to prevent the insertion. Moreover, when the dimensions in the height direction of the second walls are reduced extremely, if, for example, the perpendicular fitting female terminal is inserted into the hole, etc. of the housing, the stability of the perpendicular fitting female terminal can not be secured, hence it is necessary to secure this dimension to some extent. In that case, as the depressed part is provided, the position of the contact formed on the inner face of the depressed part in the height direction comes closer towards the leaf spring in comparison with a case wherein the depressed part is not provided. Hence the degree of freedom in setting the elasticity coefficient of the leaf spring is increased.

Said perpendicular fitting female terminal may be so formed that the first wall is provided integrally on both the ends in the width direction thereof with the second walls, said second walls are provided integrally with end walls facing in the height direction and opposing to said first wall, and said end walls are overlapped with each other to form the first wall opposing to said first wall, and the two end walls of the first wall are respectively provided with projection-receiving holes for receiving a locking projection being energized from the housing for mounting towards the body and decreasing in section towards the top end thereof, and a part on which the locking projection is to be hooked in the edge of the projection-receiving hole of the outer end wall protrudes more than a part on which the locking projection is to be hooked in the edge of the projection-receiving hole of the inner end wall.

With this arrangement, as the end walls are overlapped with each other, the bending strength, twisting strength and other strengths of the body are enhanced more, the strength against prying forces is enhanced more, and the perpendicular fitting female terminal is effectively prevented from deformation to ensure stable fitting-up of the perpendicular fitting female terminal and the plug over a long period. Now, when the locking projection enters into the projection-receiving holes, the locking projection will be hooked on the edge of the projection-receiving hole of the outer end wall, but will not be hooked on the edge of the projection-receiving hole of the inner end wall. In that case, as the cross section of the locking projection decreases towards the top end thereof, the cross section of the part corresponding to the outer end wall of the locking projection is larger than the cross section of the part corresponding to the inner end wall. Accordingly, the area of the critical section of the locking projection, namely, the weakest section of the locking projection is secured to be larger in comparison with the area obtained when the edge of the projection-receiving hole of the inner end wall contacts the locking projection, and in turn, the shearing stress working on the locking projection is suppressed and the shearing strength of the locking projection is increased relatively. Moreover, in comparison with a case when the edge of the projection-receiving hole of the inner end wall contacts the locking projection, the point of action of the force exerted to the locking projection is closer to the root of the locking projection, hence the bending force working on the locking projection near its root is suppressed, and the bending strength of the locking projection is increased relatively.

Accordingly, the strength against prying forces is enhanced more, and the perpendicular fitting female terminal is effectively prevented from deformation to ensure stable fitting-up of the perpendicular fitting female terminal and the plug over a long period, and the shearing strength and the bending strength of the locking projection can be enhanced, and fitting-up or detachment of the electric connector and the plug can be made stably over a long period.

The housing for mounting the perpendicular fitting female terminal according to the present invention is a housing wherein two receiving chambers each comprising two first composite walls to face the two first walls of the body of the perpendicular fitting female terminal respectively and two second composite walls to face the two second walls respectively and being structured to have the perpendicular fitting female terminal inserted from one end thereof are so arranged side by side that the directions of insertion of the perpendicular fitting female terminals are substantially the same, and of the two first composite walls of the respective receiving chambers, the first composite walls on the same side are opposed to each other on the inner side, and of the two second composite walls of the respective receiving chambers, the second composite walls being on the same side and being arranged side by side are provided, at parts thereof corresponding to the receiving holes, with insertion ports into which the plugs are to be inserted.

When two perpendicular fitting female terminals are so inserted into the two receiving chambers of this housing that the first walls on the same side are opposed to each other on the inner side, an electric connector that fits with or separates from two plugs arranged side by side is produced. This housing allows to utilize the characteristics of the perpendicular fitting female terminal of the present invention and restrain and shorten the overall length of the perpendicular fitting female terminal and the plug at the time of fitting-up, and as the plug can be accepted through either one of the receiving holes, common use of the female terminal can be advanced to reduce costs, and moreover, as female terminals are arranged symmetrically, a symmetrical electric connector is realized.

Of said housing, in a housing wherein the perpendicular fitting female terminals are provided with the leaf spring on only one first wall of the two first walls, the two receiving chambers may be so provided that of the two first composite walls of the respective receiving chambers, the first composite walls that are to face the first walls having no leaf spring are opposed to each other on the inner side.

With this arrangement, when two perpendicular fitting female terminals are inserted into two receiving chambers of the housing to make an electric connector, and this electric connector is brought closer to two plugs arranged side by side to fit them together, the housing might be so tilted sometimes that the distance from one insertion port to the plug corresponding to it and the distance from the other insertion port to the plug corresponding to it differ from each other. However, in that case, the plug of which said distance is shorter would reach the insertion port first, but because of the tilt of the housing, this plug would strike the first wall that is located on the inner side and with no leaf spring rather than the leaf spring that is located on the outer side. Hence the leaf spring would not be subjected to any prying force.

Accordingly, when the electric connector is brought to two plugs arranged side by side to fit them together, even if the housing is tilted, the leaf springs would not be subjected to prying forces, and the electric connector can be stably fitted up with the plug over a long period.

Of said housing, in a housing to mount therein the perpendicular fitting female terminals wherein the first wall is provided with the leaf spring, and the first wall opposing to the first wall is provided with the depressed part being depressed towards the leaf spring near a center in the width direction of the first wall and being continuous to the end of the body on the side opposite to the connecting part side, of the two first composite walls of the respective receiving chambers, the first composite wall to face the first wall having the depressed part may be provided with a convex part that is to enter into the depressed part.

With this arrangement, when the perpendicular fitting female terminal is to be inserted into the receiving chamber of the housing, if the perpendicular fitting female terminal is so inserted that the depressed part thereof comes to the same side with that of the convex part of the housing, the perpendicular fitting female terminal can be inserted. If the perpendicular fitting female terminal is reversed in the height direction and inserted, the convex part will strike the body of the perpendicular fitting female terminal and the perpendicular fitting female terminal cannot be inserted. Thus the reverse insertion prevention function is exhibited.

Accordingly, reverse insertion of the perpendicular fitting female terminal into the housing can be prevented.

Said housing may be provided with a housing guide extending from the end on the side of inserting the perpendicular fitting female terminals in a direction substantially opposing to the inserting direction of the plugs.

With this arrangement, when two perpendicular fitting female terminals are inserted in the two receiving chambers of this housing to make an electric connector, and a device having two plugs protruding side by side from the top thereof is placed on the far side and the electric connector is to be brought from the near side towards and over the device and fitted with the plugs, if the electric connector is shifted into the back, the housing guide will strike the face of the device on the near side. This timing is used as a guide for stopping the rearward shift of the electric connector. When the connector is lowered in that position, the insertion ports of the housing will meet the plugs. Then the electric connector is fitted with the plugs.

Accordingly, the workability of the fitting-in operation of the electric connector and the plugs is improved.

Said housing may be so formed that of the two first composite walls of the respective receiving chambers, the inner first composite walls are provided with third composite walls facing the connecting parts of the perpendicular fitting female terminals, on the near side in the inserting direction of the perpendicular fitting female terminals, and conductor locking hooks being open to the inner side of the receiving chambers and serving for locking conductors including electric wires connected to the connecting parts of the perpendicular fitting female terminals are provided near the ends of the third composite walls on the near side in the inserting direction of the perpendicular fitting female terminals.

With this arrangement, when two perpendicular fitting female terminals having the connecting parts connected to conductors including electric wire are inserted into the two receiving chambers of the housing to make an electric connector, of the two first composite walls of the respective receiving chambers, the outer first composite wall is open on the near side in the inserting direction of the perpendicular fitting female terminal, hence it is easy to insert the perpendicular fitting female terminal into the receiving chamber. At the same time, if the conductor including electric wire being connected to the perpendicular fitting female terminal is pulled around to this open side, the perpendicular fitting female terminal might come off the receiving chamber or the conductor including electric wire might be disconnected from the perpendicular fitting female terminal. However, if this conductor including electric wire is locked on the conductor locking hook, such a pulling-around force will be countered by the conductor locking hook, and the perpendicular fitting female terminal will not come off the receiving chamber and the conductor including electric wire will not be disconnected from the perpendicular fitting female terminal.

BRIEF DESCRIPTION OF THE DRAWINGS

FIG. 21 is a side view illustrating an electric connector comprising the housing of the embodiment and the perpendicular fitting female terminal of the second embodiment set therein. The electric connector is being put over a device with two plugs protruding from a top face thereof. The top end of a housing guide is contacting a side face of the device, and the device is sectioned vertically in a plane that is on the near side of that.

DETAILED DESCRIPTION OF THE INVENTION

In the following, embodiments of the present invention will be described. FIG. 1 through FIG. 9 illustrate the perpendicular fitting female terminal 100 of the first embodiment. This perpendicular fitting female terminal 100 is fitted with a well-known plug. The plug 200 illustrated in this embodiment comprises a plate piece made of an electrically conductive material and protrudes from a casing or the like of a device. The plug suffices to be a bar-like connecting member having conductivity, and its sectional form does not matter. The plug may be set in a connector.

Figure 7:
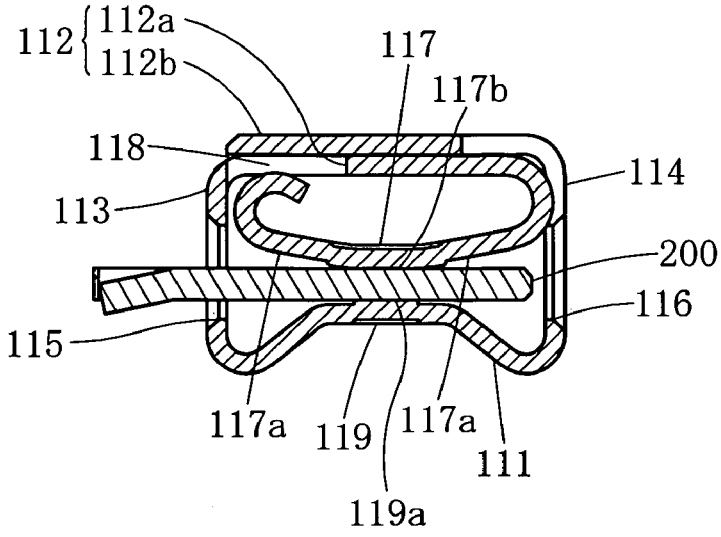
FIG. 7 is a sectional view of the perpendicular fitting female terminal of the first embodiment sectioned in a plane facing in the depth direction. A plug is accepted through one receiving hole.
Figure 8:
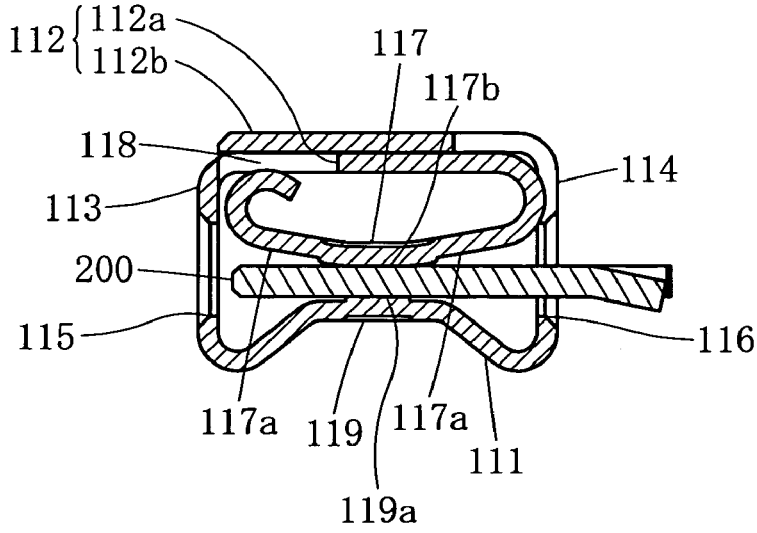
FIG. 8 is a sectional view of the perpendicular fitting female terminal of the first embodiment sectioned in a plane facing in the depth direction. A plug is accepted through the other receiving hole.
Figure 9:
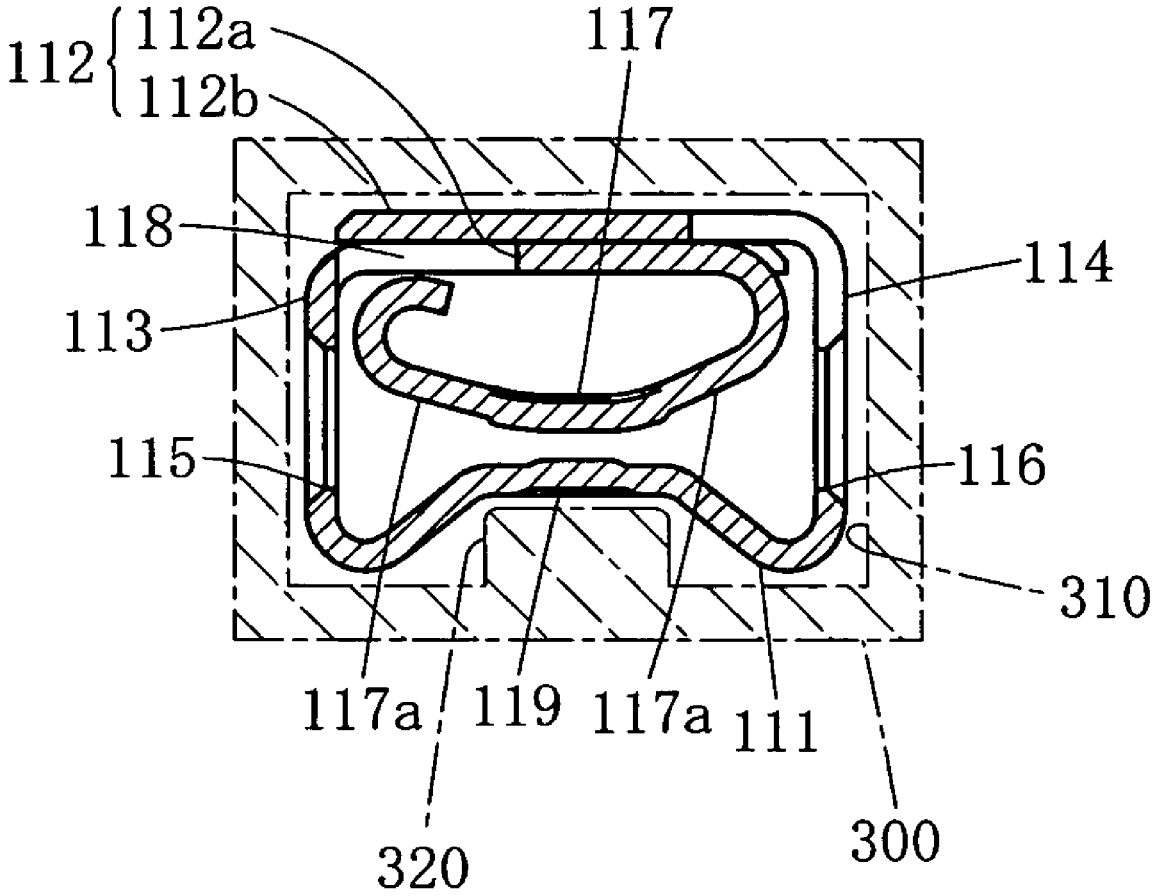
FIG. 9 is a sectional view of the perpendicular fitting female terminal of the first embodiment sectioned in a plane facing in the depth direction. A housing storing this perpendicular fitting female terminal is illustrated by imaginary line.

In the following, for convenience, a height direction, a width direction and a depth direction all perpendicular to each other are defined, and the explanation will be given on the basis of them. With reference to FIG. 7 through FIG. 9, the top-bottom direction of the diagrams is the height direction, the left-right direction of the diagrams is the width direction, and the direction perpendicular to the plane of the diagrams is the depth direction. The perpendicular fitting female terminal 100 comprises a body 110 and a connecting part 120 that is aligned with the body 110 in the depth direction and is integrally provided with the body 110. This connecting part 120 is structured to be connected to an electric wire (not illustrated), but the connecting part may be structured to be connectable to conductors other than electric wires, for example, flat-type flexible cables such as FFC (flexible flat cable) and FPC (flexible printed circuit). Both the body 110 and the connecting part 120 are made of an electrically conductive material.

The body 110 is provided with two first walls 111, 112 and two second walls 113, 114. The first walls 111, 112 have a substantially rectangular form when seen in the thickness direction thereof, one side being in the depth direction and the other side in the width direction. The second walls 113, 114 have a substantially rectangular form when seen in the thickness direction thereof, one side being in the depth direction and the other side being in the height direction. As for the two first walls 111, 112, the faces of the larger areas are perpendicular to the height direction, hence the two walls are facing in the height direction. The two first walls 111, 112 are opposed to each other in the height direction. As for the two second walls 113, 114, faces of large area are perpendicular to the width direction, hence these walls are facing in the width direction. Two second walls 113, 114 are opposed to each other in the width direction. The body 110 is provided by two first walls 111, 112 and two second walls 113, 114 in a tubular form and extends in the depth direction.

The structure of the body 110 will be described in detail. The second wall 113 is integrally provided on one end in the width direction of the first wall 111, and the second wall 114 opposing to said second wall 113 is integrally provided on the other end. An end wall 112*a* facing in the height direction and opposing to said first wall 111 is integrally provided on the second wall 113, and an end wall 112*b* facing in the height direction and opposing to said first wall 111 is integrally provided on the second wall 114 opposing said second wall 113. These end walls 112*a*, 112*b* are overlapped with each other to comprise the first wall 112 opposing to said first wall 111. To put it in other words, sides in the height direction of two second walls 113, 114 are integrally provided on both sides in the width direction of the first wall 111. And, of the sides in the height direction of the second wall 113, the side more distant from said first wall 111 is integrally provided with a side in the width direction of the end wall 112*a*, and of the sides in the height direction of the second wall 114 opposing to said second wall 113, the side more distant from the first wall 111 is integrally provided with a side in the width direction of the other end wall 112*b*, and these end walls 112*a*, 112*b* are overlapped with each other, the end wall 112*a* inside and the other end wall 112*b* outside, to comprise the first wall 112 opposing to said first wall 111.

The connecting part 120 is provided with a well-known insulation barrel 122 and a well-known wire barrel 123 and is so structured that an electric wire (not illustrated) can be crimp-connected to it by crimping the insulation barrel 122 over the insulation of the wire and crimping the wire barrel 123 over the wire core exposed from the insulation. The connecting part may be so structured, for example, that an electric wire can be insulation-displacement-connected to it or that an electric wire can be connected to it by piercing. Furthermore, the connecting part may be so structured that conductors other than wires, such as flat-type flexible cables including FFC and FPC can be connected to it.

The connecting part 120 comprises a base 121 extending in the depth direction from the first wall 111, and an insulation barrel 122 and a wire barrel 123 both rising from the base 121. These insulation barrel 122 and wire barrel 123 rise from the base 121 on the opposite side of the body side in the height direction. When seen in the depth direction, the insulation barrel 122 and the wire barrel 123 are located opposite to the body 110 in the height direction with a neighborhood of the base 121 serving as a boundary. An embodiment similar to this is an embodiment of perpendicular fitting female terminal wherein the connecting part comprises a base extending in the depth direction from the first wall 112 opposing to said first wall 111 and an insulation barrel and a wire barrel both rising from the base on the side opposite to the body side in the height direction. Moreover, an embodiment similar to this is an embodiment of perpendicular fitting female terminal wherein the connecting part comprises a base extending in the depth direction from either one of the second walls and an insulation barrel and a wire barrel both rising from this base on the side opposite to the body side in the width direction.

Two second walls 113, 114 are respectively provided with receiving holes penetrated for receiving a plug 200. One second wall 113 is provided with a receiving hole 115 penetrating in the width direction, and the other second wall 114 is provided with a receiving hole 116 penetrating in the width direction. These receiving holes 115, 116 are provided in positions substantially opposing to each other in the width direction.

Figure 1:
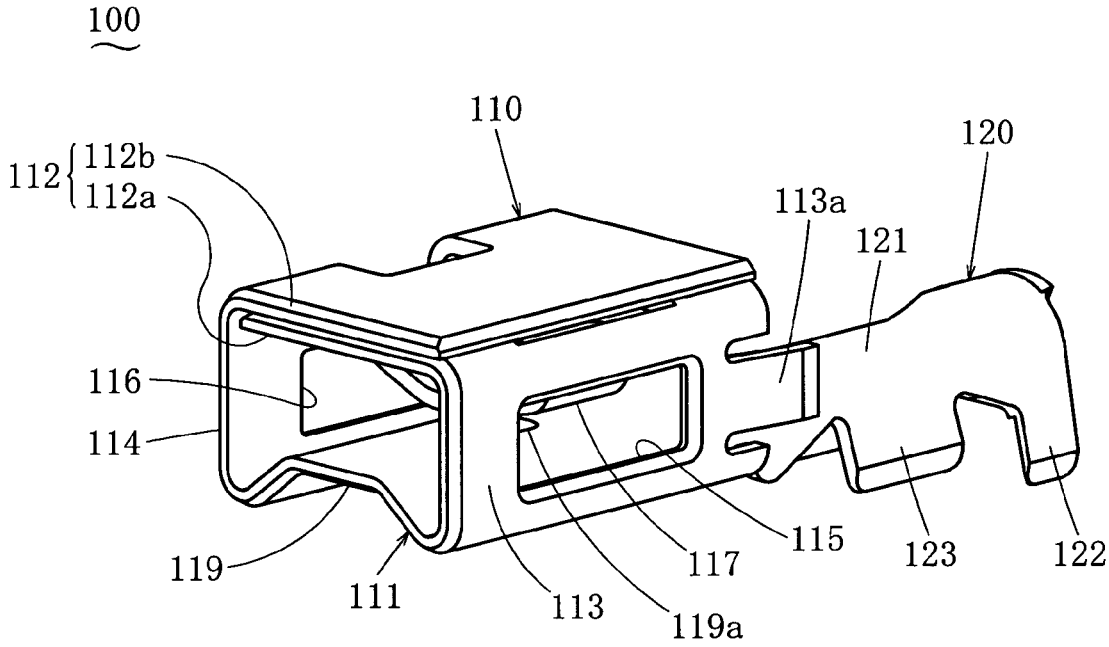
FIG. 1 is a perspective view of the perpendicular fitting female terminal of the first embodiment.
Figure 2:
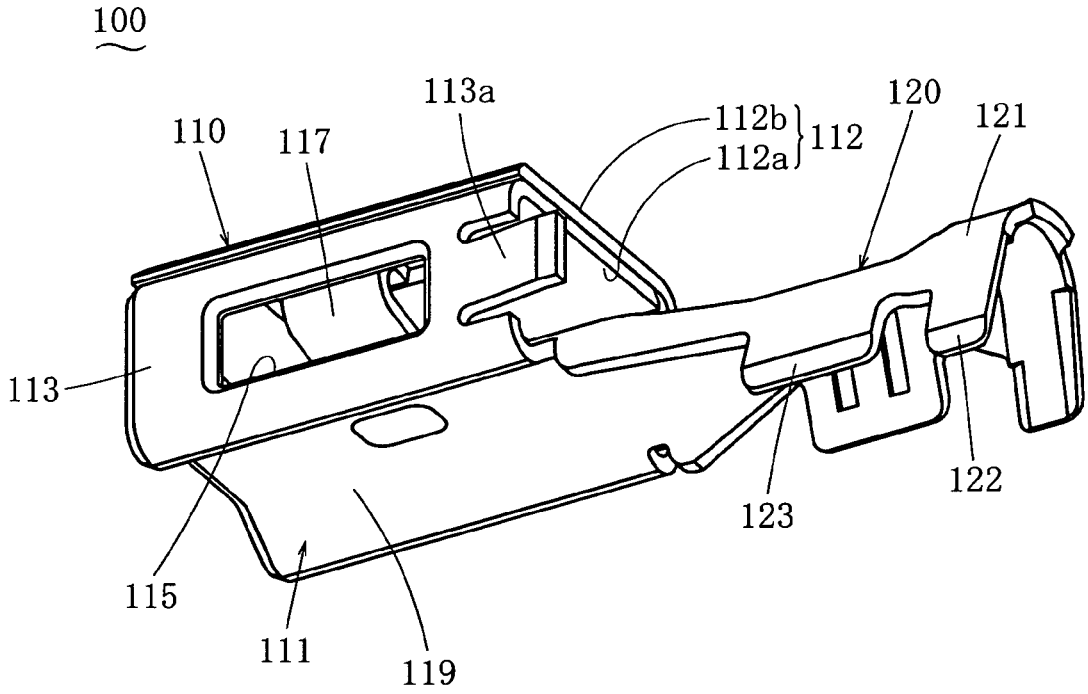
FIG. 2 is a perspective view of the perpendicular fitting female terminal of the first embodiment seen from a direction different from that of FIG. 1.
Figure 3:
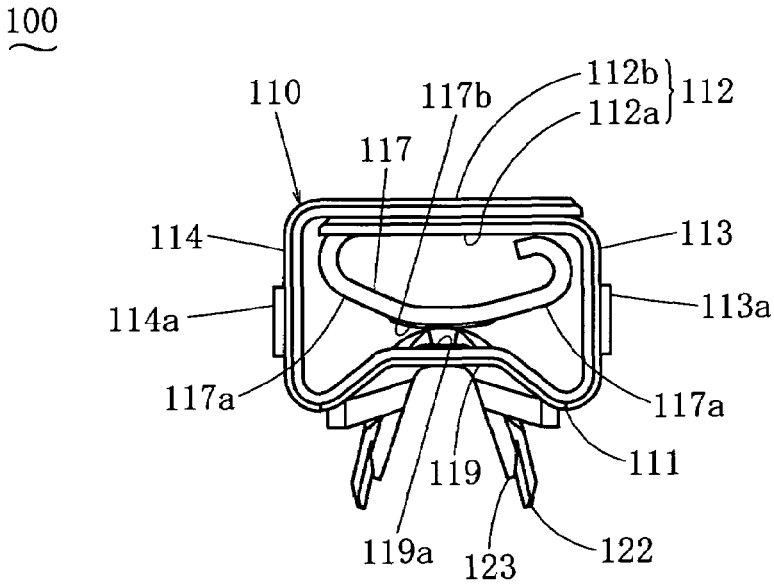
FIG. 3 is a front view of the perpendicular fitting female terminal of the first embodiment.
Figure 4:
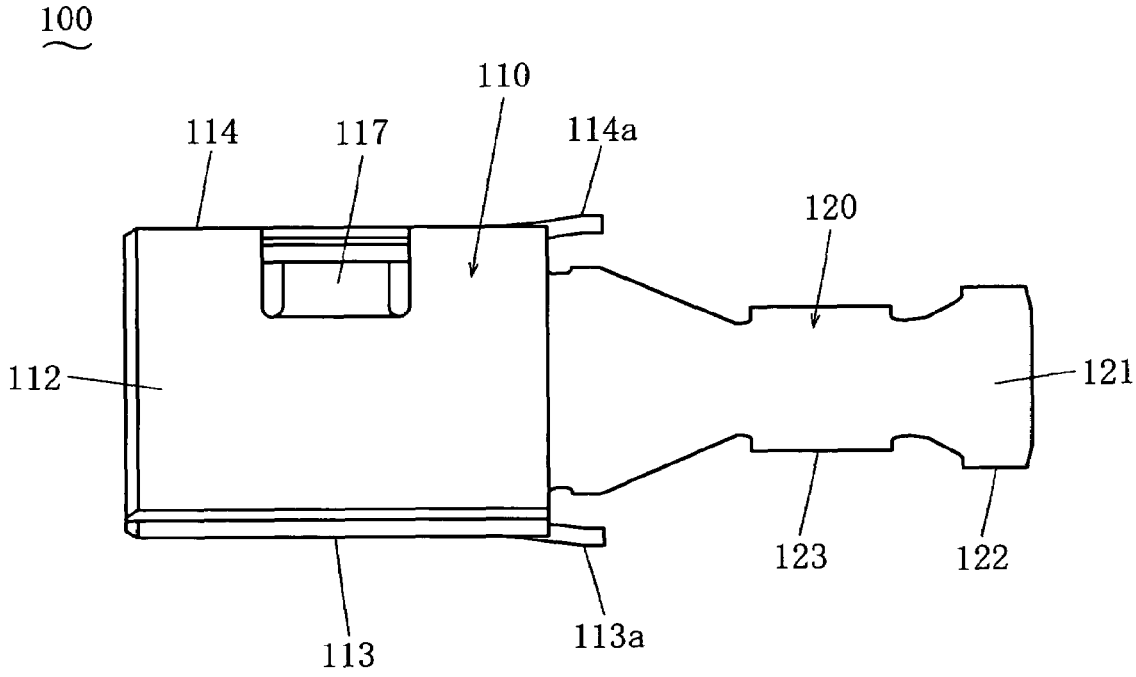
FIG. 4 is a plan view of the perpendicular fitting female terminal of the first embodiment.
Figure 5:
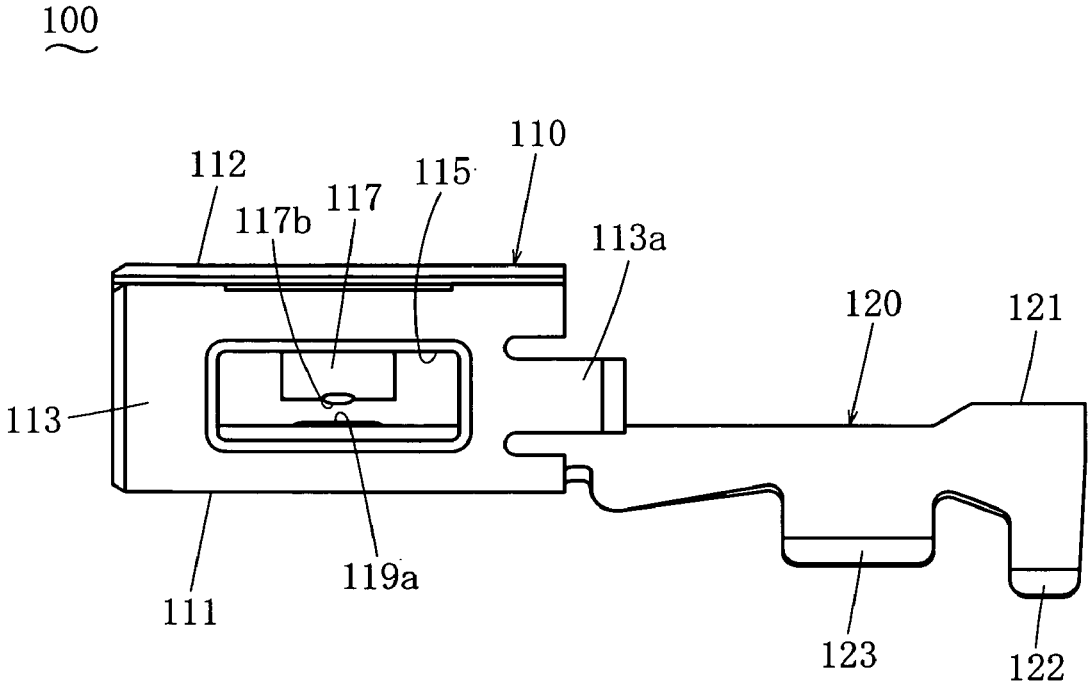
FIG. 5 is a side view of the perpendicular fitting female terminal of the first embodiment.
Figure 6:
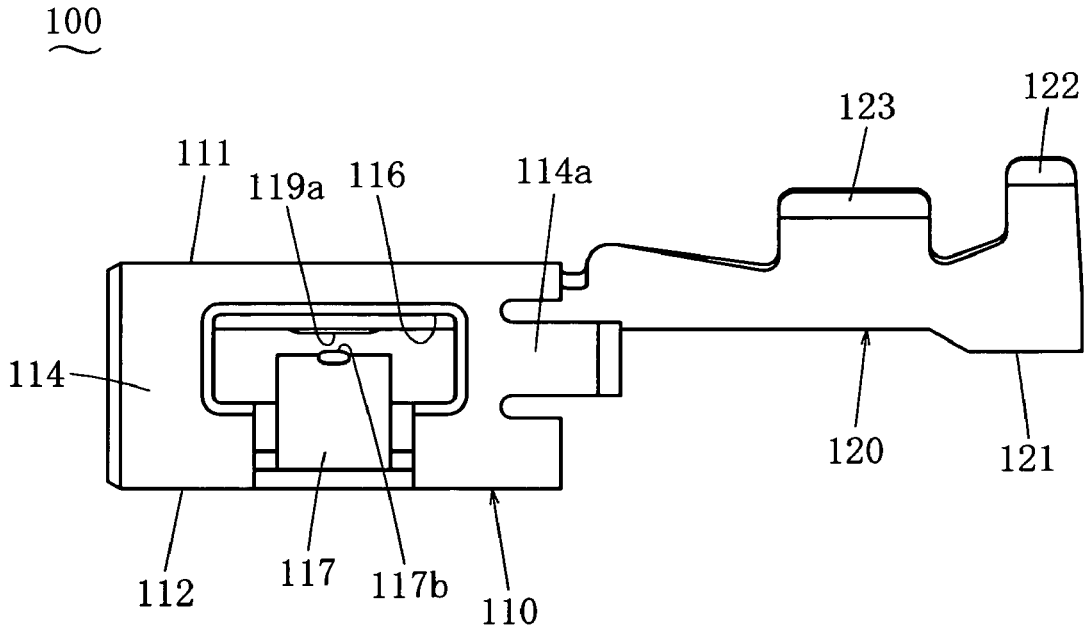
FIG. 6 is a side view of the perpendicular fitting female terminal of the first embodiment seen from the opposite side of FIG. 5.

A leaf spring 117, which undergoes elastic deformation in the height direction, is provided inside the body 110. This leaf spring 117 is comprised of a plate piece integrally provided on the body 110. Here one end of the plate piece is integrally provided on the body 110, however, both ends thereof may be integrally provided on the body. The leaf spring 117 is so structured that when a plug 200 is received through either one of the receiving holes 115, 116, the leaf spring 117 will be pushed by the plug 200 to undergo elastic deformation in the height direction. As shown in FIG. 5 and FIG. 6, when the receiving holes 115, 116 are seen in the width direction, the leaf spring 117 protrudes in the receiving holes 115, 116 in the height direction, and when the plug 200 is received through either one of the receiving holes 115, 116, the leaf spring 117 will be pushed by the plug 200 to undergo elastic deformation in the height direction towards the first wall 112 with which the leaf spring 117 is integral. As shown in FIG. 5 and FIG. 6, when the receiving holes 115, 116 are seen in the width direction, a contact 117*b* for contacting the plug 200 is provided at an end face in the height direction of the leaf spring 117. As shown in the diagrams, it is desirable to make the contact 117*b* protrude from the surface of the leaf spring 117 because it enhances determination of a contact point. One face of the plug 200, which is received in the receiving hole 115 or 116, contacts the leaf spring 117, and the face opposite to it in the height direction contacts a contact 119*a* of a depressed part 119 as will be described later. When a depressed part is not provided in the first wall, it may be arranged that the plug contacts the inner side of the first wall or the plug contacts the circumference of the receiving hole. The leaf spring may be provided one either one of the two first walls opposing to each other, or the leaf spring may be provided on both first walls.

This leaf spring 117 is formed of a plate piece that is reversed from one end in the width direction of the first wall 112 inside the body 110 to extend to the other end in the width direction of the first wall 112, and the top end thereof is reversed towards said first wall 112.

As described above, this first wall 112 is comprised of the end walls 112*a*, 112*b* overlapping with each other in the height direction, and said leaf spring 117 is reversed from one end in the width direction of the inner end wall 112*a* to extend to the other end in the width direction of the inner end wall 112*a* and the top end thereof is reversed towards the inner end wall 112*a*. This inner end wall 112*a* is provided, by cutting off a portion thereof, with a storing part 118, which stores the top end of the leaf spring 117 when the leaf spring 117 undergoes elastic deformation towards the end wall 112*a*.

The leaf spring 117 is provided with guiding parts 117*a*, which extend respectively from a neighborhood of a center in the width direction towards both the ends in the width direction while backing away in the height direction from the receiving holes 115, 116. The guiding parts may be so inflected that their surfaces are curved or they may be constituted of a plurality of flat faces. Accordingly, the leaf spring may be provided with guiding parts that are tilted to back away in the height direction from the receiving holes while extending from a neighborhood of a center in the width direction towards both the ends in the width direction. One embodiment of this is one wherein a leaf spring is formed to have parts having V-shaped sections as guiding parts.

Figure 10:
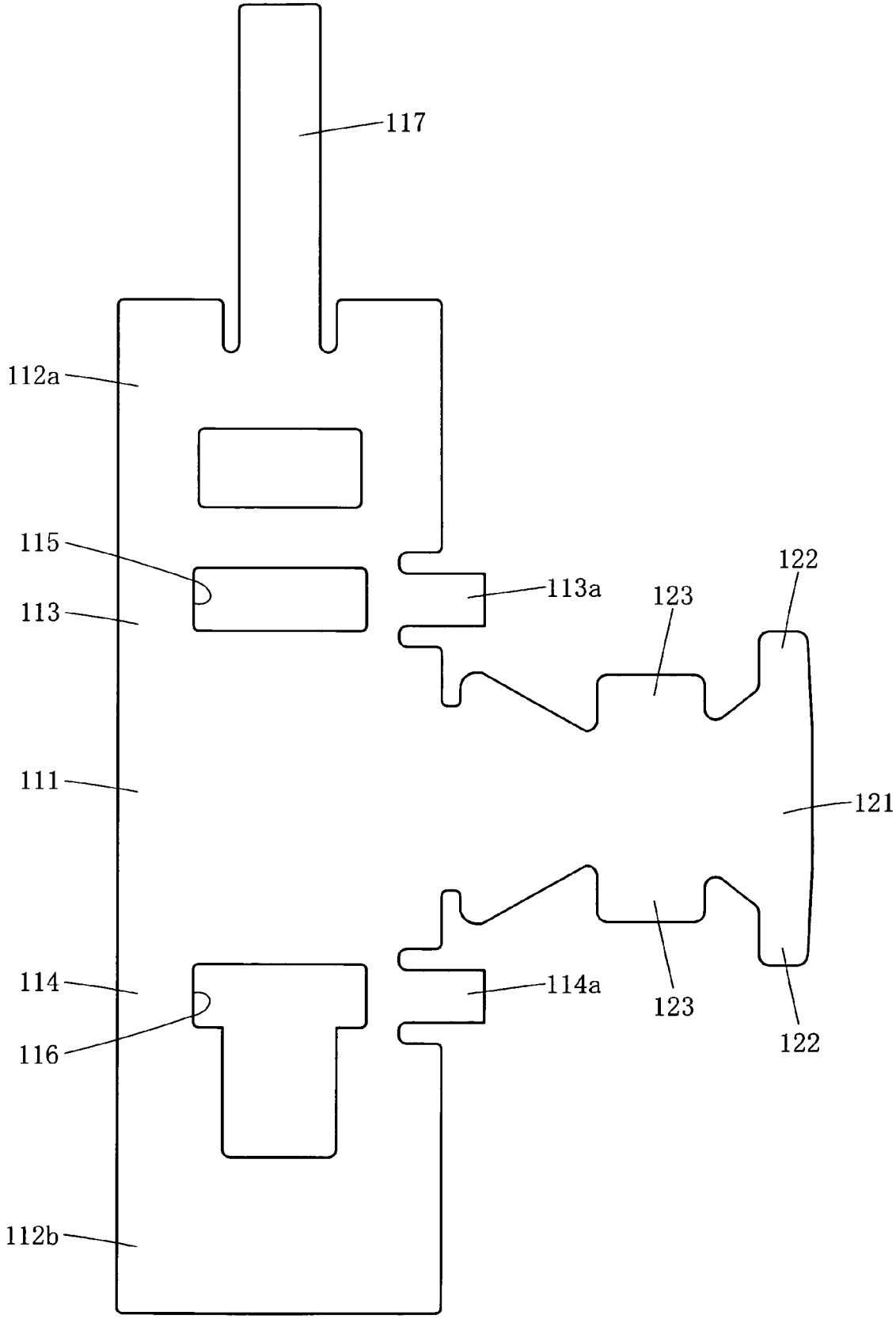
FIG. 10 is a diagram illustrating the perpendicular fitting female terminal of the first invention in a developed form.

As described above, while the leaf spring 117 is provided on the first wall 112, a depressed part 119 being depressed towards the leaf spring 117 is provided near a center in the width direction of the first wall 111 opposing to the first wall 112 and is continuous to an end of the body 110 on the side opposite to that of the connecting part 120. As shown in FIG. 5 and FIG. 6, when the receiving holes 115, 116 are seen in the width direction, the inner face of the depressed part 119 protrudes in the height direction inside the receiving holes 115, 116. Hence when the plug 200 is received through either the receiving hole 115 or the receiving hole 116, the leaf spring 117 will contact the inner face of the depressed part 119. As shown in FIG. 5 and FIG. 6, a contact point 119*a* for contacting the plug 200 is provided at a part of the depressed part 119, which is the end face in the height direction when the receiving holes 115, 116 are seen in the width direction. As shown in the diagrams, it is desirable to make the contact 119*a* protrude from the inner face of the depressed part 119 because it allows easier determination of the contact point. 113*a* and 114*a* are locking pieces extending from the second walls 113, 114 of the body 110 in the depth direction and tilting outwardly in the width direction. When the perpendicular fitting female terminal is inserted through a hole of the housing from the body side, the locking piece will be flexed and then restore itself to fit into a depressed part formed depressively in the hole of the housing so as to prevent the perpendicular fitting female terminal from easily coming off the housing. FIG. 10 is a diagram illustrating the developed configuration of the perpendicular fitting female terminal 100 of the embodiment. This perpendicular fitting female terminal 100 is produced, for example, by punching out a blank of the configuration of FIG. 10 from a plate material with a die and bending the blank. However, it may be produced by other methods.

Accordingly, when said perpendicular fitting female terminal 100 of the first embodiment is to be used, an electric wire is connected to the connecting part 120, and the plug 200 is accepted through either the receiving hole 115 or the receiving hole 116 of the body 110. Then the leaf spring 117 will be pushed by the plug 200 to undergo elastic deformation in the height direction, and this will fit up the perpendicular fitting female terminal 100 and the plug 200 with a contact force, and in turn the perpendicular fitting female terminal 100 and the plug 200 will make mechanical and electrical connections (refer to FIG. 7 and FIG. 8). When the receiving hole 115 or 116 of the body 110 and the plug 200 are separated from each other, the perpendicular fitting female terminal 100 and the plug 200 will be disconnected from each other. In this case, in comparison with a female terminal which is structured to extend in the same direction with the direction of extension of a plug at the time of fitting-up and receive the plug through the top end thereof, the overall length of the perpendicular fitting female terminal 100 and the plug 200 at the time of fitting-up can be made shorter.

For example, the configurations of the insulation barrel 122 and the wire barrel 123 and the layout of an electric wire connected to them might be greater than a space around them. Like this example, when one attempts to receive a plug through one receiving hole 115 or 116 to fit up the perpendicular fitting female terminal and the plug, if they can not be fitted together because of the restraints given by the surrounding space, it might be possible, sometimes, to receive the plug 200 through the other receiving hole 116 or 115 to fit up the perpendicular fitting female terminal 100 and the plug 200. As a result of this, the probability of fitting up the perpendicular fitting female terminal 100 and the plug 200 improves. Moreover, when a plurality of female terminals are assembled in a housing to make an electric connector, this perpendicular fitting female terminal can be assembled into the housing in two modes, namely, one for accepting the plug 200 through one receiving hole 115 and the other one for accepting the plug 200 through the other receiving hole 116 by reversing the perpendicular fitting female terminal 100. Hence female terminals to be arranged in a plurality of locations can be provided by this perpendicular fitting female terminal 100, and this in turn advances common use of this same female terminal for female terminals to be arranged in a plurality of locations, lowering the costs.

When the perpendicular fitting female terminal 100 is to be fitted with the plug 200 or to be separated from the plug 200, even if the perpendicular fitting female terminal 100 is subjected to a prying force by the plug 200, the perpendicular fitting female terminal 100 exhibits high strength against prying forces because the body 110 is structured to have a tubular form having two first walls 111, 112 opposing to each other in the height direction and two second walls 113, 114 opposing to each other in the width direction, and the body 110 has high strengths including bending strength and twisting strength, and in turn has a high strength against prying forces. Thus the perpendicular fitting female terminal 100 is effectively prevented from deformation to ensure stable fitting-up of the perpendicular fitting female terminal 100 and the plug 200 over a long period.

It suffices for the body of the perpendicular fitting female terminal according to the present invention to have two first walls opposing to each other in the height direction and two second walls opposing to each other in the width direction and be provided in a tubular form extending in the depth direction. In this embodiment, however, the second walls 113, 114 are integrally provided on both ends in the width direction of the first wall 111, end walls 112*a*, 112*b* facing in the height direction and opposing to said first wall 111 are integrally provided on the second walls 113, 114, and these end walls 112*a*, 112*b* are overlapped with each other to comprise the first wall 112 opposing to said first wall 111. With this arrangement, as the end walls 112*a*, 112*b* are overlapped with each other, the bending strength, twisting strength and other strengths of the body 110 are enhanced more, the strength against prying forces is enhanced more, and the perpendicular fitting female terminal 100 is effectively prevented from deformation to ensure stable fitting-up of the perpendicular fitting female terminal 100 and the plug 200 over a long period.

It suffices for the connecting part of the perpendicular fitting female terminal according to the present invention to be aligned with the body in the depth direction, integrally provided with the body and structured for connecting with a conductor such as electric wire. Accordingly, the present invention includes an embodiment of the perpendicular fitting female terminal wherein the connecting part is comprised of a base extending in the depth direction from the first wall or the second wall and an insulation barrel and a wire barrel rising from the base in the height direction or in the width direction on the same side with the body. In this embodiment, however, the connecting part 120 is comprised of the base 121 extending in the depth direction from the first wall 111, 112 or the second wall 113, 114 and the insulation barrel 122 and the wire barrel 123 rising from the base 121 in the height direction or in the width direction on the side opposite to the body. The perpendicular fitting female terminal 100 wherein the insulation barrel 122 and the wire barrel 123 are provided on the side opposite to the body 110 as described above has, in comparison with the perpendicular fitting female terminal wherein the insulation barrel and the wire barrel are provided on the same side with the body, a greater configuration change in the height direction or in the width direction in a neighborhood of the boundary between the body 110 and the connecting part 120, and as a whole exhibits a stepped configuration. Hence it is suitable when a space in which the perpendicular fitting female terminal 100 is located is, for example, a curved space.

It suffices for the leaf spring of the perpendicular fitting female terminal according to the present invention to be so provided inside the body that it undergoes elastic deformation in the height direction. In this embodiment, however, the leaf spring 117 is provided by a plate piece which, inside the body 110, is reversed from one end in the width direction of the first wall 112, is extended towards the other end in the width direction of the first wall 112 and the top end thereof is reversed towards the first wall 112. With this arrangement, as the top end of the plug 200 is smoothly guided by the reversed part to the face on the contact 117*b* side of the leaf spring 117, the resistance at the time of fitting-up is reduced and the fitting force is reduced. Moreover, inside the body, it is easier to work on the reversed part in comparison with a case wherein a leaf spring extending in the depth direction is provided and an edge in the width direction thereof is reversed. Furthermore, as the leaf spring 117 is constituted by reversing it from one end of the first wall 112, the dimension in the height direction of the body 110 is smaller in comparison with a case wherein, for example, a separate spring is assembled.

The structure of the first wall of the perpendicular fitting female terminal according to the present invention must not be construed limitedly by the above-mentioned embodiment, and for example, the first wall may be constituted of a single plate piece. Moreover, it is sufficient for the leaf spring of the perpendicular fitting female terminal according to the present invention to be provided inside the body so that it undergoes elastic deformation in the height direction. In this embodiment, however, the first wall 112 is comprised of end walls 112*a*, 112*b* overlapping with each other in the height direction, the leaf spring 117 is provided by a plate piece which is reversed from one end in the width direction of the inner end wall 112*a*, is extended towards the other end in the width direction of the inner end wall 112*a*, and of which top end is reversed towards the inner end wall 112*a*, and the storing part 118 for storing the top end of the leaf spring 117 when the leaf spring 117 undergoes elastic deformation is provided in the inner end wall 112*a* by cutting a part thereof. With this arrangement, as the top end of the plug 200 is smoothly guided by the reversed part onto the face on the contact 117*b* side of the leaf spring 117, the resistance at the time of fitting-up is reduced, and the fitting force is reduced. Moreover, it is easier to work on the reversed part in comparison with a case wherein inside the body, a leaf spring extending in the depth direction is provided and an edge in the width direction thereof is reversed. And as the leaf spring 117 is constituted by reversing it from one end of the end wall 112*a* comprising the first wall 112, the dimension in the height direction of the body 100 is smaller in comparison with a case wherein, for example, a separate spring is assembled. Furthermore, as the thickness of the storing part 118 can be used for a part or the entirety of the displacement of the leaf spring 117, the dimension in the height direction of the body 110 is reduced.

It is sufficient for the leaf spring of the perpendicular fitting female terminal according to the present invention to be so provided that it undergoes elastic deformation in the height direction inside the body. In this embodiment, however, the leaf spring 117 is provided with curved or tilted guiding parts 117*a*, which extend respectively from a neighborhood of a center in the width direction towards both the ends in the width direction while backing away in the height direction from the receiving holes 115, 116. With this arrangement, as the top end of the plug 200 is smoothly guided by the guiding part 117*a* onto the face on the contact 117*b* side of the leaf spring 117, the resistance at the time of fitting-up is reduced, and the fitting force is reduced.

The structure of the first wall of the perpendicular fitting female terminal according to the present invention must not be construed limitedly by the above-mentioned embodiment, and for example, the first wall may be comprised of a flat plate piece. In this embodiment, however, the first wall 112 is provided with the leaf spring 117, and the first wall 111 opposing to the first wall 112 is provided in a neighborhood of a center in the width direction of the first wall 111 with the depressed part 119 depressed towards the leaf spring 117 and continuously provided on an end of the body 110 on the side opposite to the connecting part 120 side. With this arrangement, as shown in FIG. 9, for example, when the perpendicular fitting female terminal 100 to be inserted into a hole 310 of a housing 300, if a convex part 320 corresponding to said depressed part 119 is provided on the housing 300 to face the hole 310, a reverse insertion prevention function is exhibited. The reason is that even if the perpendicular fitting female terminal 100 is reversed in the height direction and an attempt is made to insert it into the hole 310 of the housing 300, the convex part 320 will hit on the body 110 to prevent the insertion. Moreover, when the dimensions in the height direction of the second walls 113, 114 are reduced extremely, if, for example, the perpendicular fitting female terminal 100 is inserted into the hole 310 of the housing 300, the stability of the perpendicular fitting female terminal 100 cannot be secured, hence it is necessary to secure this dimension to some extent. In that case, as the depressed part 119 is provided, the position of the contact 119*a* formed on the inner face of the depressed part 119 in the height direction comes closer towards the leaf spring 117 in comparison with a case wherein the depressed part 119 is not provided. Hence the degree of freedom in setting the elasticity coefficient of the leaf spring 117 is increased.

Figure 11:
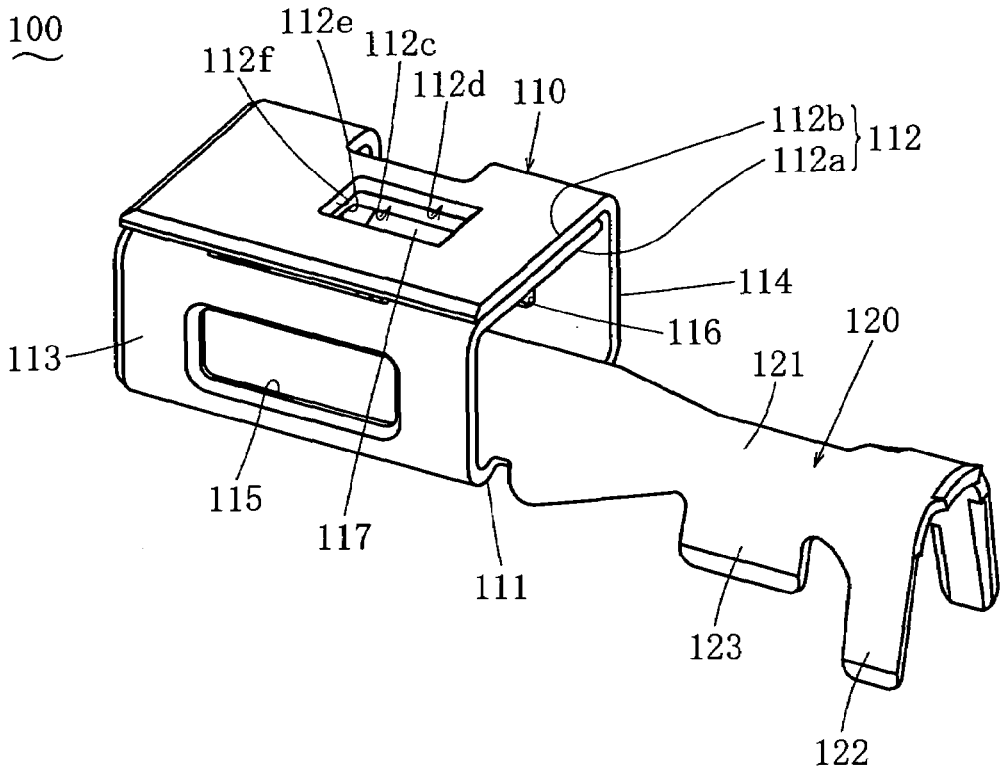
FIG. 11 is a perspective view of the perpendicular fitting female terminal of the second embodiment.
Figure 12:
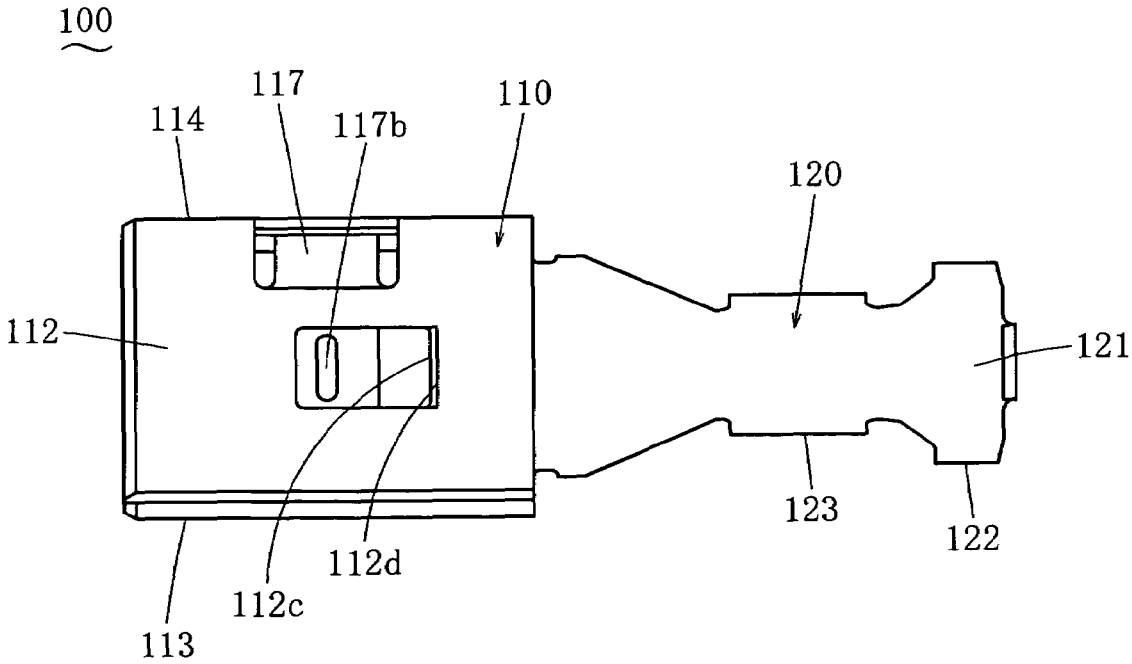
FIG. 12 is a plan view of the perpendicular fitting female terminal of the second embodiment.
Figure 13:
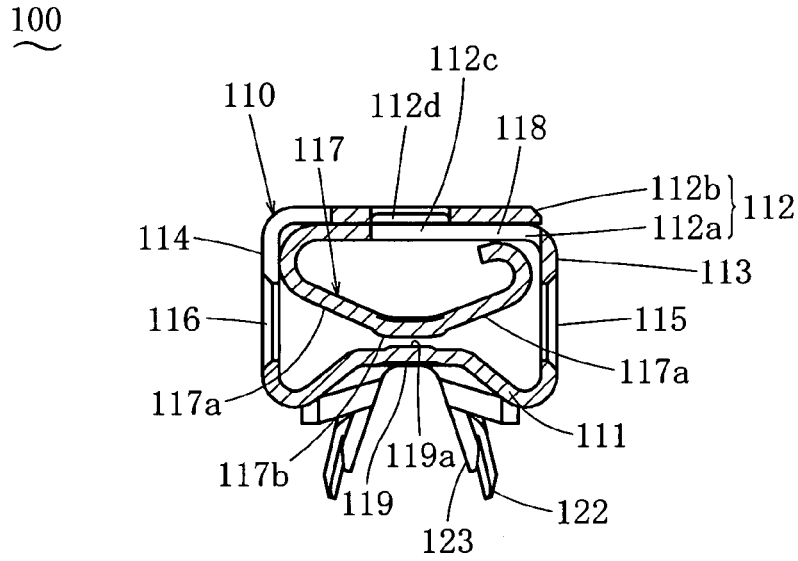
FIG. 13 is a sectional view of the perpendicular fitting female terminal of the second embodiment sectioned in a plane facing in the depth direction.

FIG. 11 through FIG. 13 illustrate a perpendicular fitting female terminal 100 of the second embodiment. This perpendicular fitting female terminal 100 differs from the perpendicular fitting female terminal 100 of the above-mentioned first embodiment in the construction of the lance, but other constructions are the same. Accordingly, the same mark is given to the same member and the description is omitted. The first embodiment adopts the so-called contact lance structure, hence locking pieces 113*a*, 114*a* extend obliquely from the second walls 113, 114 of the body 110 in the depth direction and outwards in the width direction. However, as the perpendicular fitting female terminal 100 of the second embodiment adopts the so-called housing lance structure, the body 110 is not provided with locking pieces 113*a*, 114*a*. Instead, the perpendicular fitting female terminal 100 is locked in the housing by hooking a locking projection on the first wall 112 of the perpendicular fitting female terminal 100, and said locking projection is energized from the housing in which the perpendicular fitting female terminal 100 is inserted and stored towards the body 110 and its section decreases towards the top end thereof. In the case of this embodiment, the locking projection is provided on a free end of a flexible locking piece extending from the housing in a cantilever manner along substantially the direction of inserting the perpendicular fitting female terminal, and it is so structured that the locking projection is energized towards the body 110 by the flexibility of the locking piece. The body 110 of the perpendicular fitting female terminal 100 is provided with a projection-receiving hole into which the locking projection of the locking piece is inserted. The extending direction of the locking piece from its root end towards its top end may be a direction opposing to the inserting direction of the perpendicular fitting female terminal just like the case of this embodiment or conversely it may be the inserting direction of the perpendicular fitting female terminal. The mechanism for energizing the locking projection towards the body may be, for example, the use of springs including a coil spring, and the mechanism is not limited in any way by this embodiment. The expression that the section decreases towards the top end means that the sectional area obtained when the locking projection is sectioned by a plane substantially parallel to the first composite wall decreases towards the top end.

Figure 23:
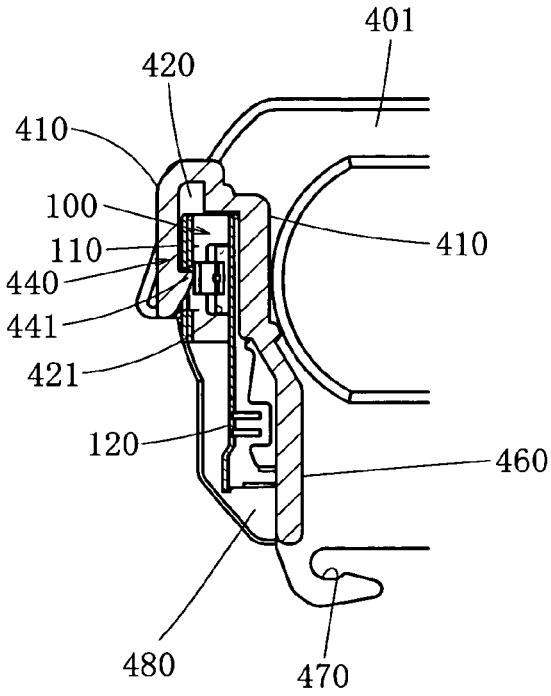
FIG. 23 is a sectional view illustrating the electric connector comprising the housing of the embodiment and the perpendicular fitting female terminal of the second embodiment set therein. The electric connector is cross-sectioned to show the inside of the receiving chamber. The perpendicular fitting female terminal is shown singly. In practice, however, an electric wire is crimped to its connecting part and the insulation barrel and the wire barrel are deformed as shown in FIG. 20 through FIG. 22.
Figure 24:
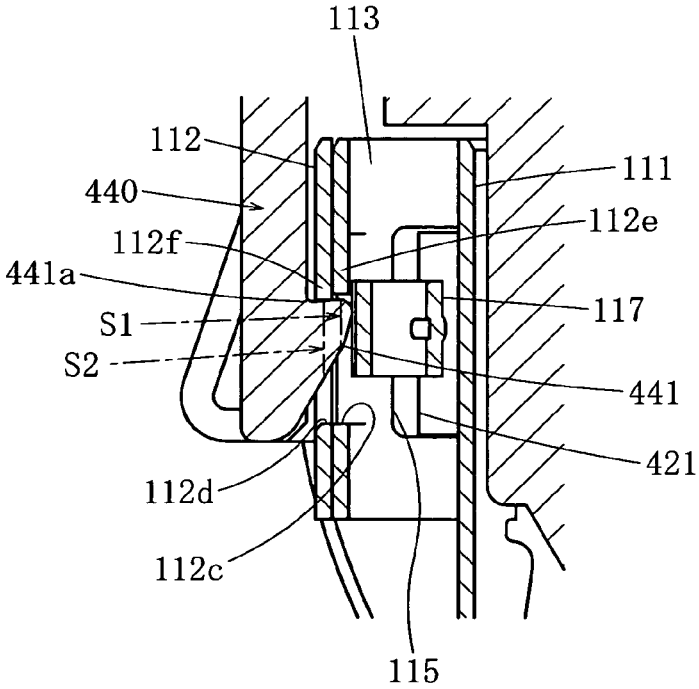
FIG. 24 is an enlarged view of an important part of FIG. 23.

In this perpendicular fitting female terminal 100, just like the case of the perpendicular fitting female terminal 100 of the first embodiment, the second walls 113, 114 are integrally provided on both ends in the width direction of the first wall 111 respectively, the end walls 112*a*, 112*b* facing in the height direction and opposing to said first wall 111 are integrally provided on the second walls 113, 114 respectively, and these end walls 112*a*, 112*b* are overlapped with each other to comprise the first wall 112 opposing said first wall 111. As illustrated in FIG. 23 and FIG. 24, a housing 400, which will be described later, is provided with a flexible locking piece 440 of cantilever structure, of which one end is fixed to the housing 400 and the other end is a free end, and a locking projection 441 is provided on this free end. They are so structured that when the locking piece 440 is displaced to flex by the body 110 of the perpendicular fitting female terminal 100 inserted, the locking projection 441 at the top end thereof will be energized towards the body 110. This locking projection is so formed that its section decreases towards the top end. Two end walls 112*a*, 112*b* of the first wall 112 are respectively provided with projection-receiving holes into which the locking projection 441 of the locking piece 440 enters. In other words, the inner end wall 112*a* is provided with a projection-receiving hole 112*c*, and the outer end wall 112*b* is provided with a projection-receiving hole 112*d*. Moreover, as illustrated in FIG. 24, a part 112*f* on which the locking projection 441 is to be hooked in the edge of the projection-receiving hole 112*d* of the outer end wall 112*b* protrudes more than a part 112*e* on which the locking projection 441 is to be hooked in the edge of the projection-receiving hole 112*c* of the inner end wall 112*a*. The parts 112*e*, 112*f* on which the locking projection 441 is to be hooked are, of the edges of the projection-receiving holes 112*c*, 112*d*, one of edges facing both ends in the depth direction of the projection-receiving hole 112*c* and one of edges facing both ends in the depth direction of the projection-receiving hole 112*d*. In this embodiment, of these edges, parts 112*e*, 112*f* on which the locking projection 441 is to be hooked are in the edges being more distant from the connecting part 120. These parts 112*e*, 112*f* extend substantially linearly in the width direction, but these configurations may be modified according to the configuration of the locking projection.

The actions and effects of the perpendicular fitting female terminal 100 of the second embodiment are similar to those of the perpendicular fitting female terminal 100 of the first embodiment except the action and effect regarding the lance structure. In the case of the perpendicular fitting female terminal 100 of the second embodiment, when this perpendicular fitting female terminal 100 is inserted from the body side into a receiving chamber 430 of a housing 400 which will be described later, the locking piece 440 will be flexed and then will restore to fit into the projection-receiving holes 112*c*, 112*d* of the end walls 112*a*, 112*b*, and the perpendicular fitting female terminal 100 will be locked on the housing 400 and will not come off easily. When the locking projection 441 enters into the projection-receiving holes 112*c*, 112*d*, the locking projection 441 will be hooked on the part 112*f* of the edge of the projection-receiving hole 112*d* of the outer end wall 112*b*, but will not be hooked on the part 112*e* of the edge of the projection-receiving hole 112*c* of the inner end wall 112*a*. In that case, as the cross section of the locking projection 441 decreases towards the top end thereof, the cross section of the part corresponding to the outer end wall 112*b* (S2 of FIG. 24) of the locking projection 441 is larger than the cross section of the part corresponding to the inner end wall 112*a* (S1 of FIG. 24). Accordingly, the area of the critical section of the locking projection 441, namely, the weakest section of the locking projection 441 is secured to be larger in comparison with the area obtained when the part 112*e* of the edge of the projection-receiving hole 112*c* of the inner end wall 112*a* contacts the locking projection 441, and in turn, the shearing stress working on the locking projection 441 is suppressed and the shearing strength of the locking projection 441 is increased relatively. Moreover, in comparison with the case when the part 112*e* of the edge of the projection-receiving hole 112*c* of the inner end wall 112*a* contacts the locking projection 441, the point of action of the force exerted to the locking projection 441 is closer to the root 441*a* of the locking projection 441, hence the bending force working on the locking projection 441 near its root end is suppressed, and the bending strength of the locking projection 441 is increased relatively. Thus fitting-up and separation of the electric connector and the plug 200 can be made stably over a long period.

Figure 25:
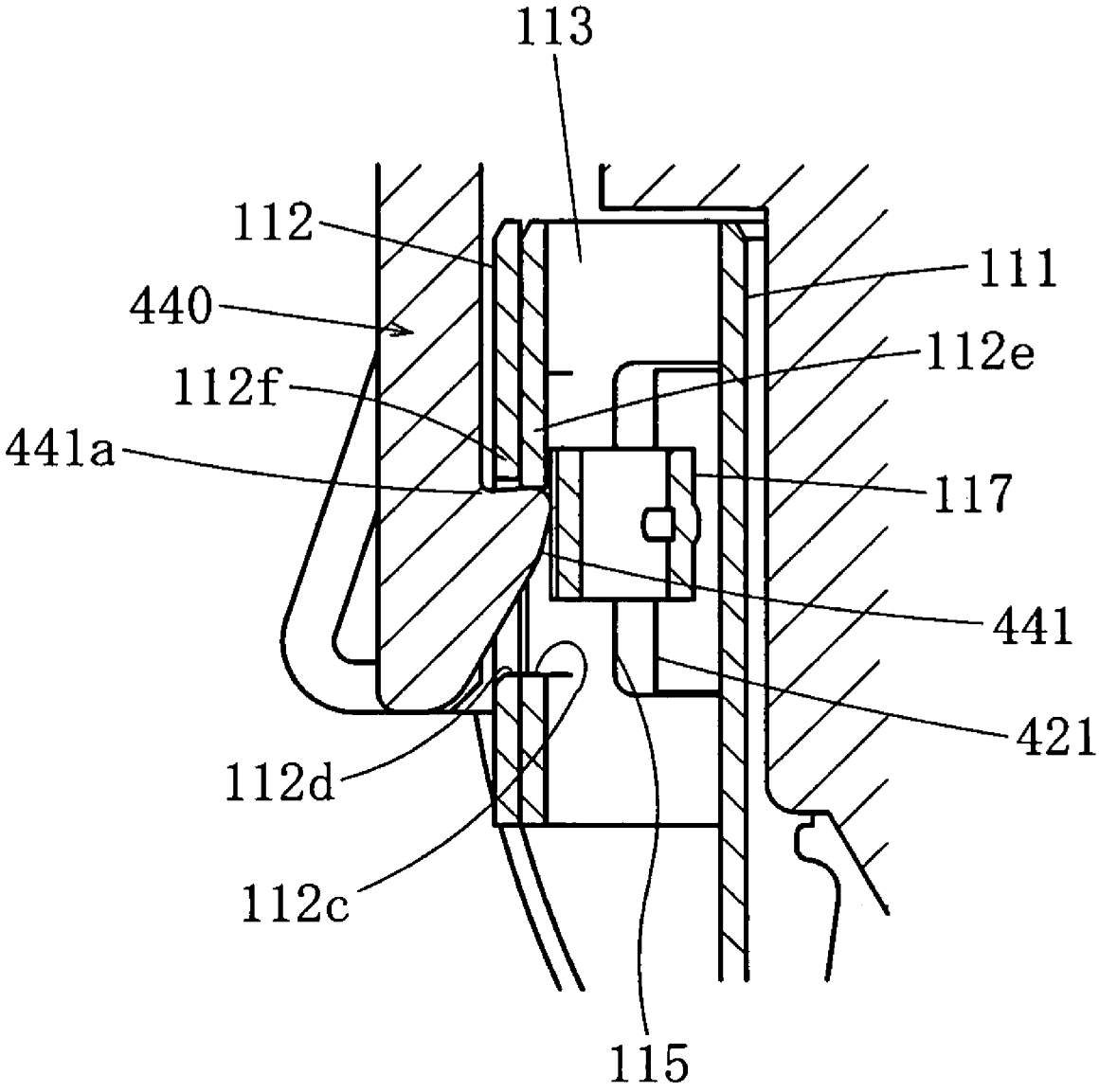
FIG. 25 is a diagram of a comparative example. The diagram corresponds to FIG. 23.

In contrast to this, in a comparative example illustrated in FIG. 25, the part 112*e* in the edge of the projection-receiving hole 112*c* of the inner end wall 112*a*, on which the locking projection 441 is to be hooked, protrudes more than the part 112*f* in the edge of the projection-receiving hole 112*d* of the outer end wall 112*b*, on which the locking projection 441 is to be hooked. As a result of this, when the locking projection 441 enters the projection-receiving holes 112*c*, 112*d*, this locking projection 441 will be hooked on the part 112*e* in the edge of the projection-receiving hole 112*c* of the inner end wall 112*a* but will not be hooked on the part 112*f* in the edge of the projection-receiving hole 112*d* of the outer end wall 112*b*. Hence the critical section of the locking projection 441 will be smaller in comparison with the case when the part 112*f* in the edge of the projection-receiving hole 112*d* of the outer end wall 112*b* contacts the locking projection 441, and in turn, the shearing stress working on the locking projection 441 will be larger, and the shearing strength of the locking protrusion 441 will be smaller. Moreover, as the point of action of the force to the locking protrusion 441 becomes more distant from the root end 441*a* of the locking projection 441, the bending force acting on a neighborhood of the root end of the locking projection 441 will be larger, and the bending strength of the locking projection 441 will be lower.

Figure 20:
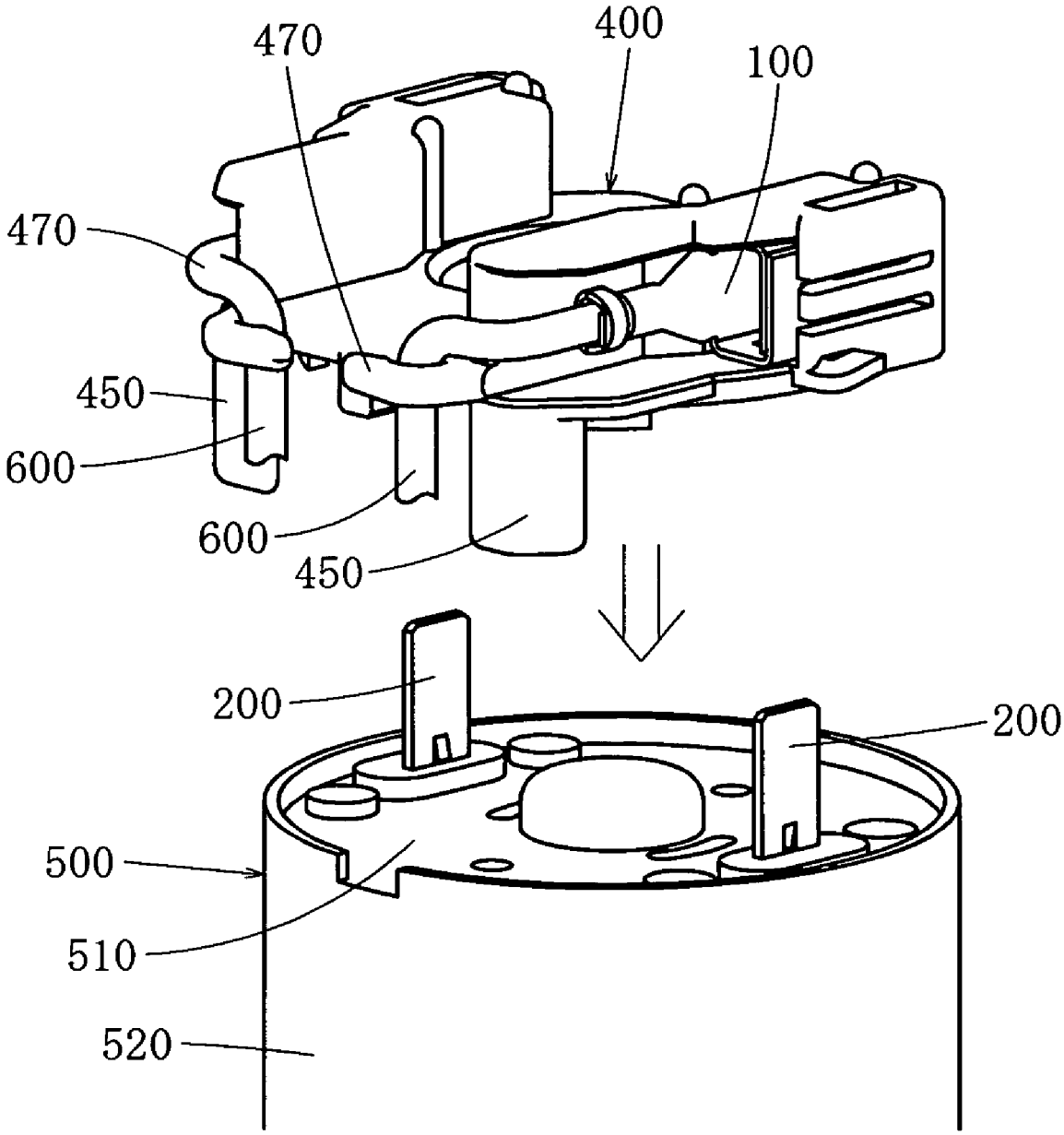
FIG. 20 is a perspective view illustrating an electric connector comprising the housing of the embodiment and the perpendicular fitting female terminals of the second embodiment being put over a device with two plugs protruding from the top face thereof.

FIG. 14 through FIG. 24 illustrate a housing 400 in which the perpendicular fitting female terminal 100 according to the present invention is mounted. The perpendicular fitting female terminal 100 of the second embodiment is mounted in this housing 400. When two perpendicular fitting female terminals 100 are mounted in this housing 400, an electric connector is resulted, and this electric connector is connected to a counterpart device 500 from which two plugs 200 protrude. As shown in FIG. 20, in this embodiment, the device 500 is substantially cylindrical, an electric motor is stored therein and two plugs 200 protrude side by side from a substantially circular top 510. Then, as shown in FIG. 20, when the electric connector is put over the device 500 from the top side and pushed down onto the top 510, the perpendicular fitting female terminals 100 of the electric connector will be fitted up with the plugs 200, and when the electric connector is lifted to separate it away from the top 510, the perpendicular fitting female terminals 100 of the electric connector will be disconnected from the plugs 200. However, the structure, configuration and use of the housing in which the perpendicular fitting female terminal of the present invention is mounted and the devices to be stored in the housing must not be limitedly construed in any way by this embodiment.

Figure 21:
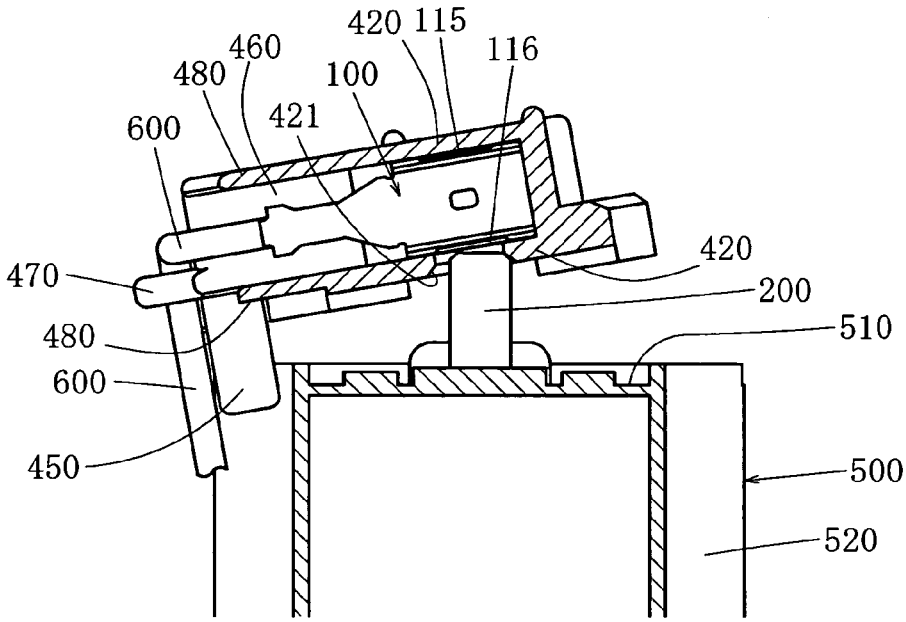
Figure 22:
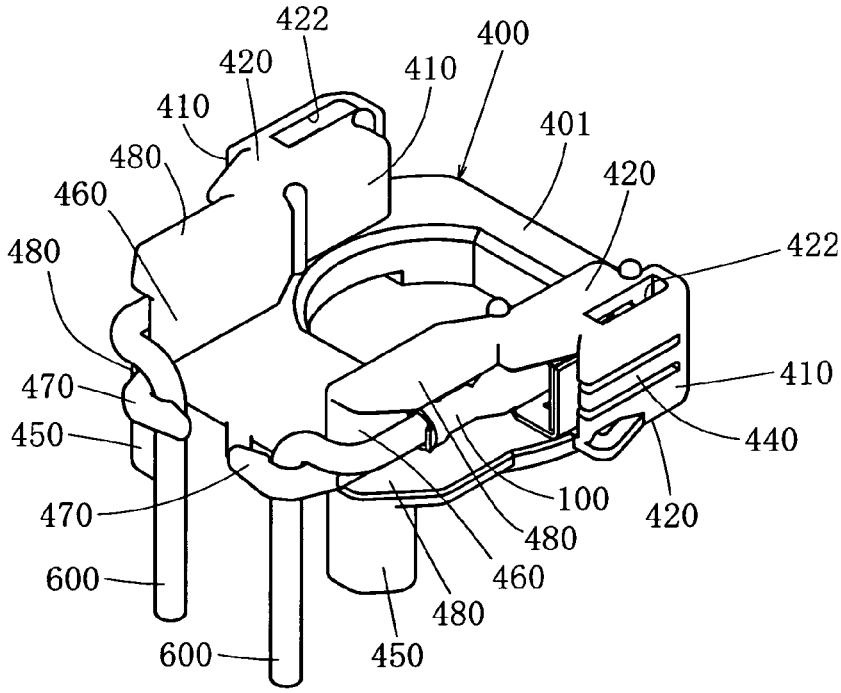
FIG. 22 is a perspective view of an electric connector comprising the housing of the embodiment and the perpendicular fitting female terminals of the second embodiment set therein. The wires that are connected to the connecting parts of the perpendicular fitting female terminals are locked onto conductor locking hooks.

The housing 400 is comprised of an insulating material and is provided with a plate-like base 401 having a given thickness. Two receiving chambers 430 are provided side by side with a distance from each other in the base 401. The receiving chamber 430 is comprised of two first composite walls 410 being to face the two first walls 111, 112 of the body 110 of the perpendicular fitting female terminal 100 respectively and two second composite walls 420 being to face the two second walls 113, 114 respectively, and is so structured that the perpendicular fitting female terminal 100 is inserted from one end thereof. The two perpendicular fitting female terminals 100 inserted are arranged to be substantially parallel to each other. The other end of the receiving chamber 430 is closed, but it may be kept open. These receiving chambers 430 are so arranged side by side that the directions of insertion of the perpendicular fitting female terminals 100 are substantially the same, and of the two first composite walls 410 of the respective receiving chambers 430, the first composite walls 410 on the same side are opposed to each other on the inner side. The first composite walls on the same side are the first composite walls 410 that are to face the first walls 111 or the first composite walls 410 that are to face the first walls 112, but in this embodiment the former first composite walls 410. Of the two second composite walls 420 of the respective receiving chambers 430, the second composite walls 420 being on the same side and being arranged side by side are provided respectively, at parts corresponding to the receiving holes 115, with insertion ports 421 into which the plugs 200 are to be inserted. Of the two second composite walls 420 of the respective receiving chambers 430, there are the second composite walls 420 that are on the near side when seen from the front side of the housing 400 and the second composite walls 420 that are on the near side when seen from the rear side. The former in FIG. 21 is the second composite walls 420 on the upper side, and the latter is the second composite walls 420 on the lower side of the diagram. The second composite walls 420 on the same side are on the same side in this sense. In this embodiment, the second composite walls 420 on the same side are the second composite walls 420 on the near side when seen from the rear side of the housing 400, and they are arranged side by side. They are the second composite wall 420 that is to face the second wall 113 in one receiving chamber 430 and the second composite wall 420 that is to face the second wall 114 in the other receiving chamber 430. The second composite wall 420 opposite to the second composite wall 420 having the insertion hole 421 is provided with a check window 422 at a far part of the receiving chamber 430, namely, at a part that is to receive the top end of the body 110 of the perpendicular fitting female terminal 100 when the perpendicular fitting female terminal 100 is inserted. With this arrangement, when the perpendicular fitting female terminal 100 is fully inserted into the receiving chamber 430, the top end of the body 100 can be checked visually from the outside through the check window 422.

This perpendicular fitting female terminal 100 is provided with the leaf spring 117 on only the first wall 112 of the two first walls 111, 112. In the housing 400 in which two such perpendicular fitting female terminals 100 are mounted, two receiving chambers 430 are so provided that of the two first composite walls 410 of the respective receiving chambers 430, the first composite walls 410 that are to face the first walls 111 having no leaf spring 117 are opposed to each other on the inner side.

Figure 17:
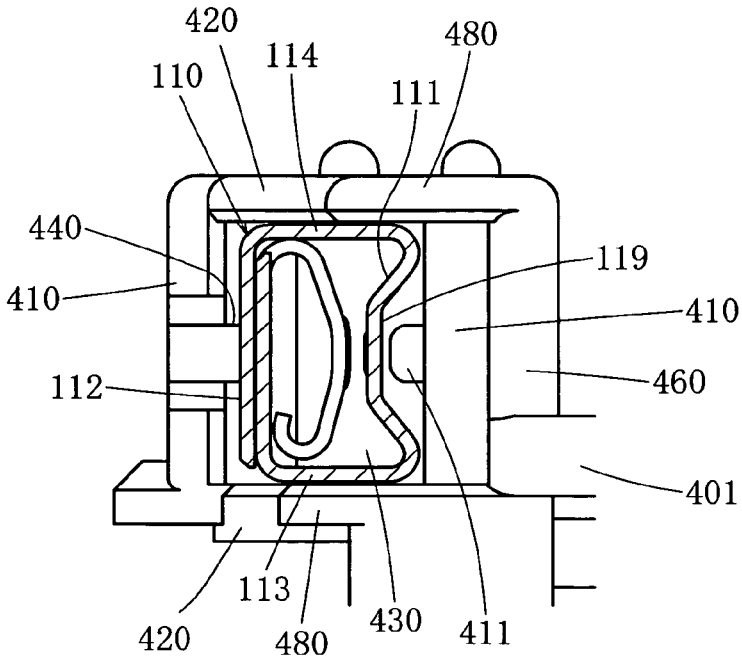
FIG. 17 is an enlarged view illustrating the perpendicular fitting female terminal of the second embodiment inserted in the receiving chamber of the housing of the embodiment in the proper orientation. The perpendicular fitting female terminal is sectioned.
Figure 18:
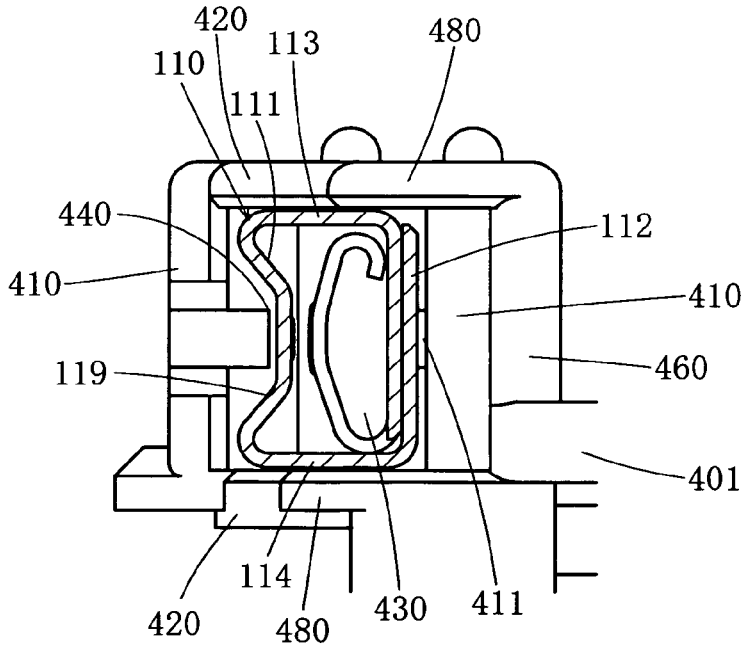
FIG. 18 is an enlarged view illustrating the perpendicular fitting female terminal of the second embodiment inserted in the receiving chamber of the housing of the embodiment in the reversed orientation in relation to the proper orientation and the height direction. The perpendicular fitting female terminal is sectioned.
Figure 19:
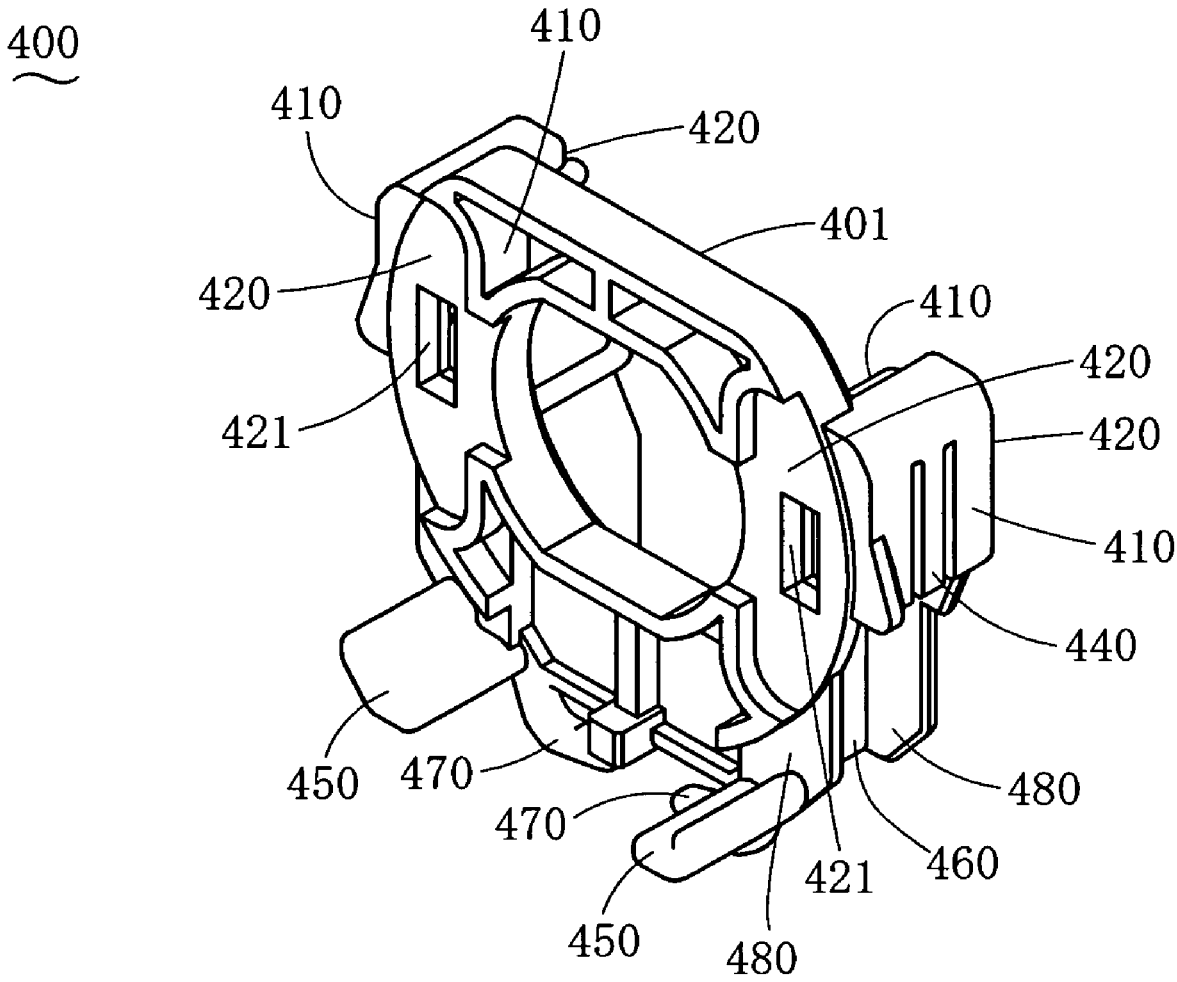
FIG. 19 is a perspective view of the housing of the embodiment seen from the back side thereof.

In this perpendicular fitting female terminal 100, the first wall 112 is provided with the leaf spring 117, and the first wall 111 opposing to the first wall 112 is provided in a neighborhood of a center in the width direction with the depressed part 119 depressed towards the leaf spring 117 and continuously provided from the end of the body 110 on the side opposite to the connecting part. As illustrated in FIG. 17 and FIG. 18, in the housing 400 on which two such perpendicular fitting female terminals 100 are mounted, of the two first composite walls 410 of the respective receiving chambers 430, the first composite wall 410 that is to face the first wall 111 having the depressed part 119 is provided with a convex part 411 that is to enter into the depressed part 119.

As shown in FIG. 14, FIG. 19 and FIG. 20 through FIG. 22, the housing 400 is provided with two housing guides 450 that extend from the end on the side of inserting the perpendicular fitting female terminals 100 in a direction substantially opposing to the inserting direction of the plugs 200. The housing guides 450 extend from the base 401. The housing guides 450 are so structured that when an electric connector comprising the housing 400 and two perpendicular fitting female terminals 100 mounted thereon is put over the device 500 from its top side, the housing guides 450 will be substantially parallel to a side face 520 extending from the circumference of the top 510 of the device 500, and will extend along the side face 520 with a small clearance from the side face 520. They may be so structured that this clearance is almost eliminated. The housing guides 450 are formed into plate-like forms, but they may be formed into bar-like forms. A single housing guide may be used alone, and three or more housing guides may be used.

Figure 14:
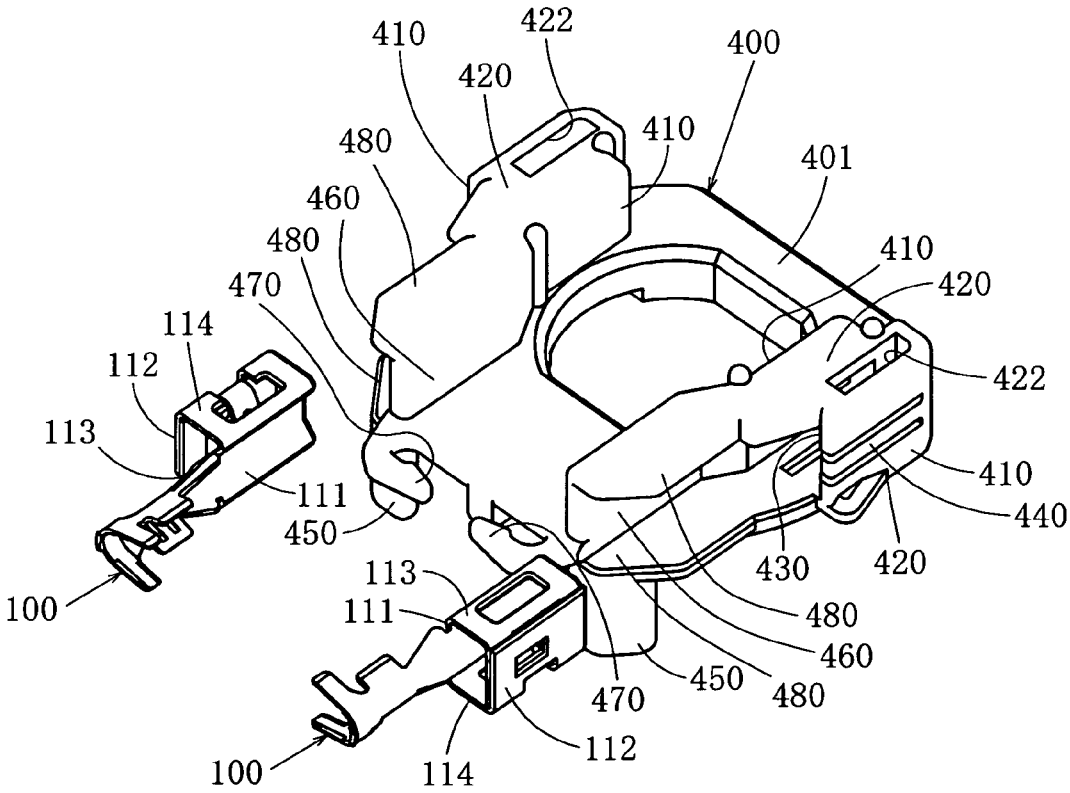
FIG. 14 is a perspective view illustrating the perpendicular fitting female terminal of the second embodiment being inserted into a receiving chamber of a housing of an embodiment. The perpendicular fitting female terminal is shown singly. In practice, however, an electric wire is crimped to its connecting part, and an insulation barrel and a wire barrel are deformed as shown in FIG. 20 through FIG. 22.
Figure 15:
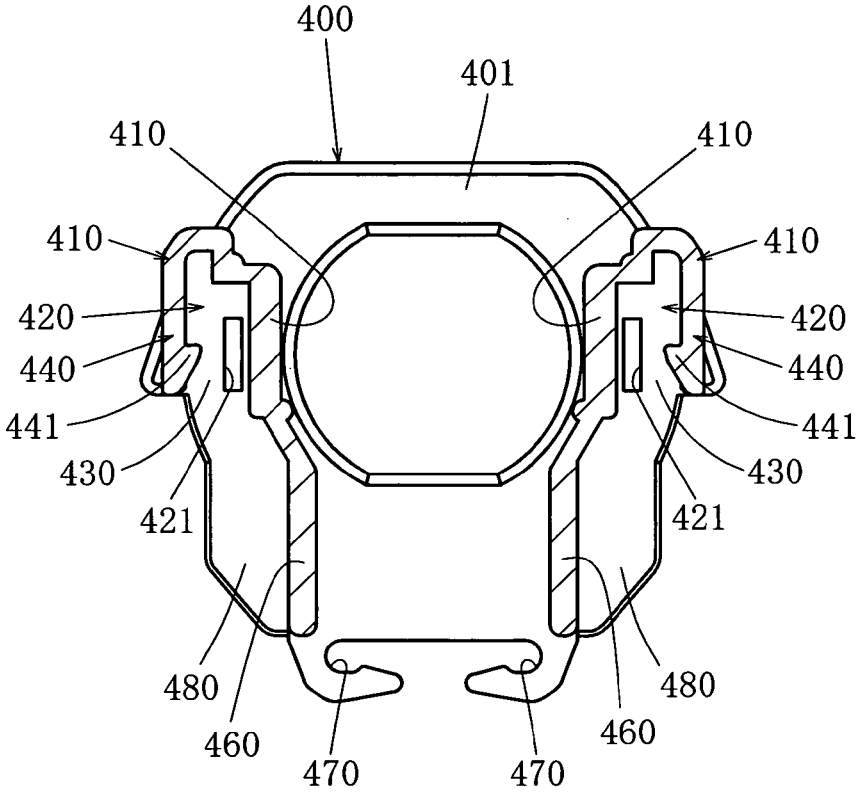
FIG. 15 is a sectional view illustrating the housing of the embodiment cross-sectioned to show the inside of the receiving chambers.

As shown in FIG. 14 and FIG. 15, in this housing 400, of the two first composite walls 410 of the respective receiving chambers 430, the inner first composite walls 410 are provided with the third composite walls 460 facing the connecting parts 120 of the perpendicular fitting female terminals 100, on the near side in the inserting direction of the perpendicular fitting female terminals 100. And as shown in FIG. 14, FIG. 15 and FIG. 19 through FIG. 23, in this housing 400, conductor locking hooks 470 opening to the inner side of the receiving chambers 430 and serving for locking electric wires 600 connected to the connecting parts 120 of the perpendicular fitting female terminals 100 are provided near the ends of the third composite walls 460 on the near side in the inserting direction of the perpendicular fitting female terminals 100. The conductor locking hooks may be so structured that other conductors in place of electric wires are locked. In this embodiment, as shown in FIG. 14, the fourth composite walls 480 rising outwards from both sides of the third composite walls 460 are provided. The fourth composite walls 480 are so provided that they are continuous to the second composite walls 420 and support both sides in the width direction of the connecting parts 120. However, the housing according to the present invention includes an embodiment wherein no such fourth composite wall is provided.

The structure of a housing on which the perpendicular fitting female terminal of the present invention is to be mounted, and the layout, number, etc. of the perpendicular fitting female terminals to be mounted on the housing must not be construed limitedly by the housing 400 of this embodiment. However, in the housing 400 of the embodiment structured as described above, when two perpendicular fitting female terminals 100 are so inserted into two receiving chambers 430 of the housing 400 that the first walls 111 on the same side are opposed to each other on the inner side, an electric connector that fits with or separates from two plugs 200 arranged side by side will be obtained. This housing 400 allows to utilize the characteristics of the perpendicular fitting female terminal 100 of the present invention and restrain and shorten the overall length of the perpendicular fitting female terminal 100 and the plug 200 at the time of fitting-up, and as the plug 200 can be accepted through either one of the receiving holes 115, common use of the female terminal can be advanced to reduce costs, and moreover, as female terminals are arranged symmetrically, a symmetrical electric connector can be realized.

Figure 16:
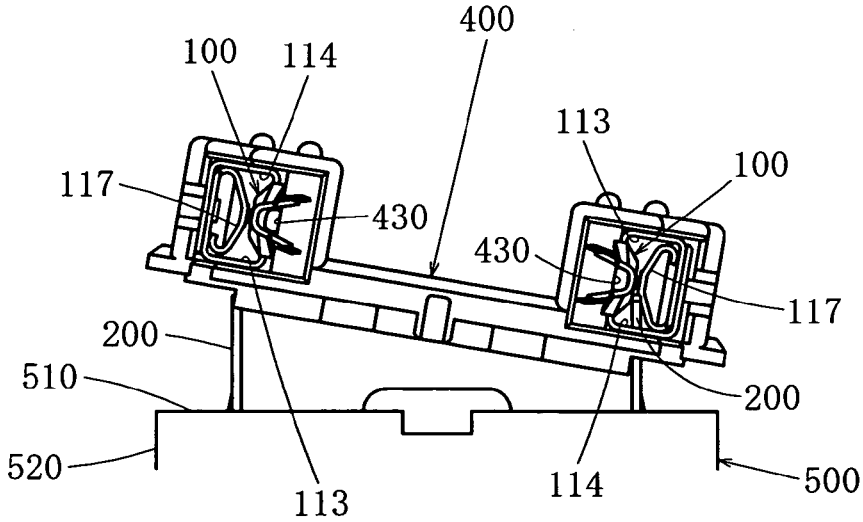
FIG. 16 is a front view illustrating an electric connector comprising the housing of the embodiment and the perpendicular fitting female terminals of the second embodiment set therein. The electric connector is being fitted with plugs by tilting the connector. The perpendicular fitting female terminals are illustrated singly. In practice, however, an electric wire is crimped to the connecting part thereof, and the insulation barrel and the wire barrel are deformed as shown in FIG. 20 through FIG. 22.

The arrangement, orientation, etc. of the perpendicular fitting female terminals in the housing according to the present invention must not be construed limitedly by the housing 400 of this embodiment. However, the housing 400 of the above-mentioned embodiment is the housing 400 on which are mounted the perpendicular fitting female terminals 100 wherein of the two first walls 111, 112, only one first wall 112 is provided with the leaf spring 117, and two receiving chambers 430 are so provided that, of the two first composite walls 410 of the respective receiving chambers 430, the first composite walls 410 being to face the first walls 111 having no leaf spring 117 are opposed to each other on the inner side. With this arrangement, as shown in FIG. 16, when two perpendicular fitting female terminals 100 are inserted into two receiving chambers 430 of the housing 400 to make an electric connector, and this electric connector is brought closer to two plugs 200 arranged side by side to fit them together, the housing 400 might be so tilted sometimes that the distance from one insertion port 421 to the plug 200 corresponding to it and the distance from the other insertion port 421 to the plug 200 corresponding to it differ from each other. However, in that case, the plug 200 of which said distance is shorter would reach the insertion port 421 first, however, because of the tilt of the housing 400, this plug 200 would strike the first wall 111 that is located on the inner side and with no leaf spring 117 rather than the leaf spring 117 that is located on the outer side. Hence the leaf spring would not be subjected to any prying force. Accordingly, the electric connector can be fitted up with the plugs 200 stably over a long period.

The configuration, etc. of the first composite walls 410 or the configuration, etc. of the second composite walls 420 of the housing according to the present invention must not be construed limitedly by the housing 400 of this embodiment. However, the housing 400 of the above-mentioned embodiment is the housing 400 having the perpendicular fitting female terminals 100 mounted therein, and in the perpendicular fitting female terminals 100, the first wall 112 is provided with the leaf spring 117, the first wall 111 opposing to the first wall 112 is provided, in a neighborhood of a center in the width direction, with the depressed part 119 being depressed towards the leaf spring 117 and being continuous to the body 110 on the end opposite to the connecting part side, and of the two first composite walls 410 of the respective receiving chambers 430, the first composite wall 410 being to face the first wall 111 having the depressed part 119 is provided with the convex part 411 being to enter in the depressed part 119. With this arrangement, when the perpendicular fitting female terminal 100 is to be inserted into the receiving chamber 430 of the housing 400, as illustrated in FIG. 17, if the insertion is made while the depressed part 119 of the perpendicular fitting female terminal 100 is kept on the same side with the convex part 411 of the housing 400, the insertion can be made. However, as illustrated in FIG. 18, if the perpendicular fitting female terminal 100 is reversed in the height direction and the insertion is attempted, the convex part 411 will strike the body 110 of the perpendicular fitting female terminal 100 to prevent the insertion. Thus the reverse insertion prevention function is exhibited to prevent reverse insertion of the perpendicular fitting female terminal 100 into the housing 400.

The housing according to the present invention includes an embodiment wherein no housing guide is provided. However, the housing 400 of said embodiment is provided with housing guides 450 extending from the end on the side of inserting the perpendicular fitting female terminal 100 and substantially opposing to the insertion direction of the plug 200. With this arrangement, as illustrated in FIG. 20, when two perpendicular fitting female terminals 100 are inserted in the two receiving chambers 430 of this housing 400 to make an electric connector, and a device 500 having two plugs 200 protruding side by side from the top 510 thereof is placed on the far side and the electric connector is to be brought from the near side towards and over the device 500 and fitted with the plugs 200, if the electric connector is shifted into the back, as illustrated in FIG. 21, the housing guides 450 will strike a side face 520 of the device 500 on the near side. This timing is used as a guide for stopping the rearward shift of the electric connector. When the connector is lowered in that position, the insertion ports 421 of the housing 400 will meet the plugs 200 and the electric connector will be fitted with the plugs 200. Accordingly, when the device 500 having two plugs 200 protruding side by side from the top 510 is placed on the far side and an attempt is made to bring the electric connector from the near side closer to, put it on the device 500 and fit up the electric connector with the plugs 200, the workability of the operation of fitting up the electric connector and the plugs 200 is enhanced.

The housing of the present invention includes an embodiment wherein no third composite wall is provided and an embodiment wherein no conductor locking hook is provided. However, in the housing 400 of said embodiment, of the two first composite walls 410 of the respective receiving chambers 430, the inner first composite wall 410 is provided with the third composite wall 460 facing the connecting part 120 of the perpendicular fitting female terminal 100, on the near side in the inserting direction of the perpendicular fitting female terminal 100, and the conductor locking hook 470 for locking conductors including electric wire 600 connected to the connecting part 120 of the perpendicular fitting female terminal 100 and being open to the inner side of the receiving chamber 430 is provided near the end of the third composite wall 460 on the near side in the inserting direction of the perpendicular fitting female terminal 100. With this arrangement, when two perpendicular fitting female terminals 100 having the connecting parts 120 connected to conductors including electric wire 600 are inserted into the two receiving chambers 430 of the housing 400 to make an electric connector, of the two first composite walls 410 of the respective receiving chambers 430 of the housing 400, the outer first composite wall 410 is open on the near side in the inserting direction of the perpendicular fitting female terminal 100, hence it is easy to insert the perpendicular fitting female terminal 100 into the receiving chamber 430. At the same time, if the conductor including electric wire 600 being connected to the perpendicular fitting female terminal 100 is pulled around to this open side, the perpendicular fitting female terminal 100 might come off the receiving chamber 430 or the conductor including electric wire 600 might be disconnected from the perpendicular fitting female terminal 100. However, if this conductor including electric wire 600 is locked on the conductor locking hook 470, such a pulling-around force will be countered by the conductor locking hook 470, and the perpendicular fitting female terminal 100 will not come off the receiving chamber 430 and the conductor including electric wire 600 will not be disconnected from the perpendicular fitting female terminal 100. Accordingly, while the insertion of the perpendicular fitting female terminals 100 into the receiving chambers 430 is made easier, even if the conductor including wire 600 connected to the perpendicular fitting female terminal 100 is pulled around, the perpendicular fitting female terminal 100 will not come off the receiving chamber 430 and the conductor including wire 600 will not be disconnected from the perpendicular fitting female terminal 100.

The embodiments described so far show very few examples of the perpendicular fitting female terminal and the housing according to the present invention. Hence the perpendicular fitting female terminal and the housing according to the present invention must not be construed limitedly by the description of these embodiments.

The disclosure of Japanese Patent Application No. 2005-299461 filed on Oct. 13, 2005 including specification, drawings and claims is incorporated herein by reference in its entirety. The disclosure of Japanese Patent Application No. 2006-970 filed on Jan. 5, 2006 including specification, drawings and claims is incorporated herein by reference in its entirety.

The invention claimed is:

1. A perpendicular fitting female terminal for fitting with a plug, comprising:

a tubular body having two first walls facing in a height direction and opposing to each other and two second walls facing in a width direction perpendicular to the height direction and opposing to each other, the two first walls and the two second walls extending in a depth direction perpendicular to both the height direction and the width direction and connected to each other so as to form a tubular passageway extending through the tubular body in the depth direction; and a connecting part being aligned with the body in the depth direction and being integrally provided with the body, and being able to be connected to a conductor including electric wire; and the two second walls being provided respectively with receiving holes penetrating inside the body in the width direction, respective ones of the receiving holes extending in the height and depth directions, a leaf spring integrally connected to one of the two first walls and being provided inside the body to undergo elastic deformation in the height direction, the leaf spring having a generally V-shaped configuration as viewed in elevation through the tubular passageway, the leaf spring having a leaf spring width extending in the depth direction such that at least a portion of the leaf spring width is viewable through either one of the receiving holes when the receiving holes are oriented in registration with one another; and subject to a plug being accepted through any receiving hole, the leaf spring to be pressed by the plug to undergo elastic deformation in the height direction, wherein the two first walls, the two second walls and the leaf spring being formed as an integral construction.

2. A perpendicular fitting female terminal according to claim 1, respective ones of the two first walls being integrally provided on respective ends in the width direction with respective ones of the two second walls, the respective ones of the two second walls being integrally provided with end walls facing in the height direction and opposing to said a remaining one of the two first walls, and the end walls being overlapped with each other to form one of the two first walls opposing the remaining one of the two first walls.

3. A perpendicular filling female terminal according to claim 1, the connecting part comprising a base extending from one of the two first walls or one of the two second walls in the depth direction, and an insulation barrel and a wire barrel both rising from the base in the height direction or the width direction on a side opposite to the body side.

4. A perpendicular filling female terminal according to claim 1, inside the body, the leaf spring being provided by a plate piece reversing from one end in the width direction of one of the two first walls, extending to the other end in the width direction of said one of the two first walls, and having a top end reversed towards said one of the two first walls.

5. A perpendicular fitting female terminal according to claim 1, the leaf spring being provided with curved or tilted guiding parts extending from a neighborhood of a center in the width direction towards both the ends in the width direction while backing away in the height direction from the receiving holes.

6. A perpendicular fitting female terminal according to claim 1, one of the two first walls being provided with the leaf spring, and a remaining one of the two first walls opposing to said one of the two first walls being provided in a neighborhood of a center in the width direction of the remaining one of the two first walls with a depressed part depressed towards the leaf spring and continuously provided from an end of the body on the side opposite to the connecting part side.

7. A perpendicular filling female terminal, comprising:

a tubular body having two first walls facing in a height direction and opposing to each other and two second walls facing in a width direction perpendicular to the height direction and opposing to each other, and the two first walls and the two second walls extending in a depth direction perpendicular to both the height direction and the width direction; and a connecting part being aligned with the body in the depth direction and being integrally provided with the body, and being able to be connected to a conductor including electric wire; and the two second walls being provided respectively with receiving holes penetrating inside the body, a leaf spring being provided inside the body to undergo elastic deformation in the height direction; and subject to a plug being accepted through any receiving hole, the leaf spring to be pressed by the plug to undergo elastic deformation in the height direction, wherein the two first walls, the two second walls and the leaf spring being formed as an integral construction, and wherein one of the two first walls being comprised of end walls overlapping with each other in the height direction with one of the end walls being disposed inside the tubular body as an inner end wall, the leaf spring being provided by a plate piece reversing from one end in the width direction of the inner end wall, extending towards the other end in the width direction of said inner end wall, and having a top end reversed towards said inner end wall, and said inner end wall being partly removed to provide a storing part for storing the top end of the leaf spring subject to the leaf spring undergoing elastic deformation.

8. A perpendicular fitting female terminal , comprising:

a tubular body having two first walls facing in a height direction and opposing to each other and two second walls facing in a width direction perpendicular to the height direction and opposing to each other, the two first walls and the two second walls extending in a depth direction perpendicular to both the height direction and the width direction; and a connecting part being aligned with the body in the depth direction and being integrally provided with the body, and being able to be connected to a conductor including electric wire; and the two second walls being provided respectively with receiving holes penetrating inside the body, a leaf spring being provided inside the body to undergo elastic deformation in the height direction; and subject to a plug being accepted through any receiving hole, the leaf spring to be pressed by the plug to undergo elastic deformation in the height direction, wherein the two first walls, the two second walls and the leaf spring being formed as an integral construction, and wherein one of the two first walls being provided integrally on opposing ends in the width direction thereof with respective ones of the two second walls, the respective ones of the two second walls being provided integrally with a respective end wall facing in the height direction and opposing a remaining one of the two first walls, and said end walls being overlapped with each other to form the one of the two first walls;

the two end walls of the one of the two first walls being respectively provided with projection-receiving holes for receiving a locking projection being energized from a housing for mounting towards the body and decreasing in section towards the top end thereof; and a part on which the locking projection being to be hooked in the edge of the projection-receiving hole of the outer end wall protruding more than a part on which the locking projection being to be hooked in the edge of the projection-receiving hole of the inner end wall.

9. A perpendicular fitting female terminal assembly, comprising: a tubular body having two first walls facing in a height direction and opposing to each other and two second walls facing in a width direction perpendicular to the height direction and opposing to each other, the two first walls and the two second walls extending in a depth direction perpendicular to both the height direction and the width direction; and a connecting part being aligned with the body in the depth direction and being integrally provided with the body, and being able to be connected to a conductor including electric wire; and the two second walls being provided respectively with receiving holes penetrating inside the body, a leaf spring being provided inside the body to undergo elastic deformation in the height direction;

subject to a plug being accepted through any receiving hole, the leaf spring to be pressed by the plug to undergo elastic deformation in the height direction, and a housing having two receiving chambers each comprising two first composite walls to face the two first walls of the body of the perpendicular fitting female terminal respectively and two second composite walls to face the two second walls respectively and structured to have the perpendicular fitting female terminal inserted from one end thereof arranged side by side with the directions of insertion of the perpendicular fitting female terminals being substantially the same, and of the two first composite walls of the respective receiving chambers, the first composite walls on the same side opposed to each other on the inner side; and of the two second composite walls of the respective receiving chambers, the second composite walls disposed on the same side and arranged side by side being provided, at parts thereof corresponding to the receiving holes, with insertion ports for the plugs to be inserted therein, wherein the two first walls, the two second walls and the leaf spring being formed as an integral construction.

10. A perpendicular fitting female terminal assembly according to claim 9:

the perpendicular fitting female terminals being provided with the leaf spring on only one first wall of the two first walls; and the two receiving chambers being provided with, of the two first composite walls of the respective receiving chambers, the first composite walls to face the first walls having no leaf spring being opposed to each other on the inner side.

11. A perpendicular fitting female terminal assembly according to claim 9:

the housing being to mount therein the perpendicular fitting female terminals wherein the first wall being provided with the leaf spring, and the first wall opposing to the first wall being provided with the depressed part being depressed towards the leaf spring near a center in the width direction of the first wall and being continuous to the end of the body on the side opposite to the connecting part side; and of the two first composite walls of the respective receiving chambers, the first composite wall to face the first wall having the depressed part being provided with a convex part being to enter into the depressed part.

12. A perpendicular fitting female terminal assembly according to claim 9, further comprising:

a housing guide extending from the end on the side of inserting the perpendicular fitting female terminals in a direction substantially opposing to the inserting direction of the plugs.

13. A perpendicular fitting female terminal assembly according to claim 9, of the two first composite walls of the respective receiving chambers, the inner first composite walls being provided with third composite walls facing the connecting parts of the perpendicular filling female terminals, on the near side in the inserting direction of the perpendicular filling female terminals, and conductor locking hooks being open to the inner side of the receiving chambers and serving for locking conductors including electric wires connected to the connecting parts of the perpendicular filling female terminals being provided near the ends of the third composite walls on the near side in the inserting direction of the perpendicular fitting female terminals.

* * * * *